US005234786A

United States Patent [19]

Ueda et al.

[11] Patent Number: 5,234,786

[45] Date of Patent: Aug. 10, 1993

[54] DEVELOPER LAYER FORMING METHOD

[75] Inventors: Masato Ueda; Tadashi Miwa; Satoshi Haneda; Masakazu Fukuchi, all of Hachioji, Japan

[73] Assignee: Konica Corporation, Tokyo, Japan

[21] Appl. No.: 800,211

[22] Filed: Nov. 29, 1991

[30] Foreign Application Priority Data

Nov. 30, 1990 [JP] Japan ..... 2-339419

[51] Int. Cl.[5] ..... G03G 13/22; G03G 13/08; G03G 13/09

[52] U.S. Cl. ..... 430/101; 430/102; 430/120; 430/122

[58] Field of Search ..... 430/101, 102, 120, 122

[56] References Cited

U.S. PATENT DOCUMENTS

| | | | |
|---|---|---|---|
| 3,676,215 | 7/1972 | Gundlach | 430/117 X |
| 4,092,165 | 5/1978 | Andrus et al. | 430/102 X |
| 4,425,382 | 1/1984 | Tajima | 430/122 X |
| 4,792,512 | 12/1988 | Haneda et al. | 430/122 X |

*Primary Examiner*—Roland Martin
*Attorney, Agent, or Firm*—Jordan B. Bierman

[57] ABSTRACT

A method of forming a developer layer on a rotating developing sleeve for developing a latent image on an image carrier, in which the developer layer is formed by conveying the developer on the sleeve below a regulating member which is applied with pressure onto the developer. The developer composed of two-component additionally contains spacer particles having a uniform diameter greater than the maximum diameter of carrier particles in the developer, which maintain a predetermined gap equal to the diameter of the spacer particles between the sleeve and the regulating member.

14 Claims, 12 Drawing Sheets

DEVELOPER LAYER FORMING METHOD

BACKGROUND OF THE INVENTION

The present invention relates to improvements in a method for forming a developer layer by which the thickness of the developer layer held and carried on the surface of a developer carrying member is regulated in a developing means to be used to develop a latent image formed on the surface of a photoreceptor drum or belt in electrophotography.

Further, the present invention relates to a contact or a non-contact developing method by which an electrostatic latent image on an image carrier is developed with a one-component or two-component developer.

In an electrophotographic image forming apparatus in which one-component or two-component developer is used, it is necessary to maintain the thickness of a developer layer formed on a developer carrying member (which is also referred to as a developing sleeve) to be thin and uniform in order to obtain images of high quality.

Conventionally, the thickness of a developer layer is regulated by a fixed regulating plate. However, in the case of the conventional fixed regulating plate, the assembling accuracy is limited when the developer carrying member and the fixed regulating plate are assembled, the reduction of eccentricity of the developer carrying member is limited, and further the accuracy of a bearing provided to the developer carrying member is limited. Therefore, the thickness of the developer layer can be reduced to 0.3 mm at the minimum.

According to the aforementioned conventional method, it is difficult to obtain a uniformly thin developer layer. In order to obtain a thin uniform layer, various developer layer thickness regulating apparatus other than the fixed regulating plate have been devised. For example, the following apparatus have been devised.

(a) The developer layer forming apparatus described in the official gazette of Japanese Patent Application Open to Public Inspection No. 43038-1979 is structured in such a manner that: in the case of a one-component toner, a developer layer thickness regulating member which is composed of a sheet-shaped resilient member, one of which is free, is bent and contacted with a developer carrying member with pressure.

(b) The developer layer forming apparatus described in the official gazette of Japanese Patent Application Open to Public Inspection No. 51848-1979 is structured in such a manner that: a plate-shaped resilient member is used in which a metallic spring and a soft resilient member are laminated; and the thickness of one-component developer layer is regulated when the loop portion of the soft resilient member is contacted with a developer carrying member with pressure.

(c) The developer layer forming apparatus described in the official gazette of Japanese Patent Application Open to Public Inspection Nos. 126567-1984 and 129879-1984 is structured in such a manner that: in a developing unit in which a one-component developer is used, a resilient roller is intermittently or continuously contacted with a developer carrying member so that a nip can be formed between them so as to regulate the developer layer thickness.

(d) The developer layer forming apparatus described in the official gazette of Japanese Patent Application No. 12627-1985 is structured in such a manner that: in a developing unit in which a one-component developer is used, a rotating roller is contacted with a developer carrying member composed of a resilient member so that the developer layer thickness can be regulated.

(e) Concerning a developer layer thickness regulating device which is applied to a two-component developer, the official gazettes of Japanese Patent Application Open to Public Inspection Nos. 191868-1987 and 191869-1987 have disclosed a technical means in which a thin developer layer is formed on a developer carrying member appropriate for non-contact development. This developer layer thickness regulating means is composed in such a manner that: one end of a resilient plate is supported by a support member and the other is directed toward the upstream side of developer flow on a developer carrying member; and the resilient plate is contacted with the surface of the aforementioned developer carrying member with pressure so that the layer thickness of developer including magnetic carrier and toner can be regulated. In the manner explained above, the developer layer thickness can be set thin more accurately than conventional regulating means.

(f) In the case of developing units in which a two-component developer is used, the official gazettes of Japanese Patent Application Open to Public Inspection Nos. 189582-1986 and 75563-1987 have disclosed a developing unit which is composed in such a manner that: a fixed plate-shaped layer thickness regulating member is provided; a magnetic member is disposed on the back of the aforementioned layer thickness regulating member; and the magnetic member is attracted by a fixed magnet provided inside a developer carrying member so that the loop portion or edge portion of the regulating plate can be pushed and contacted with the developer carrying member.

(g) The official gazettes of Japanese Patent Application Open to Public Inspection Nos. 50184-1990 and 64674-1990, and the official gazette of Japanese Utility Model Application No. 14159-1990 by the applicant, have disclosed a developing unit in which a developing amount regulating member (a thin layer rod) is provided in such a manner that it is opposed to a magnet fixed inside the developer carrying member and the aforementioned developer amount regulating member is contacted with the developer carrying member with pressure.

(h) The official gazettes of Japanese Patent Application Open to Public Inspection Nos. 282578-1989 and 283577-1989 have disclosed a developing unit in which the shape and size of the aforementioned developer amount regulating member are specified.

The disadvantages of the aforementioned conventional developer layer forming apparatus will be explained as follows: In the cases of (a) and (b), the developer layer thickness regulating member composed of a resilient member is bent, and the generated force is utilized to regulate the layer thickness. Therefore, the generated contacting force tends to be varied by the fluctuations of the rotating speed of the developer carrying member, the contacting position and the developer thickness, and further the contacting force tends to oscillate. Furthermore, countermeasures are not taken against the oscillation. Accordingly, the layer thickness regulating member resonates with a vibration generated in the image forming apparatus. Therefore, it is difficult to obtain a developer layer of a uniform thickness. Especially, in the case of apparatus (b), a soft resilient member is contacted with the developer carrying member, so that the above-described tendency is remarkably displayed. Further, the geometric shape of the nip portion is subjected to an irregular motion due to the fluctuations of the developer carrying member rotating speed, the contacting position, and the developing layer thickness, so that the area of the nip is varied. Accordingly, a problem is caused in which the thickness of the developer layer is not uniform. Other than the aforementioned inconvenience, when the nip is composed of a soft resilient member, clogging occurs in the nip due to developer, and further when the soft resilient member becomes worn out, a secular change occurs in the nip. The above-described problems tend to occur when a developer including hard material such as magnetic material and a fluidizing agent, is utilized.

A layer obtained by the apparatus of (c) and (g) is more stable and uniform than that obtained by the apparatus of (a). However, in the apparatus of (c) and (g), the layer thickness is regulated by a rotating member, so that the performance of the layer thickness regulating means of (c) and (g) is inferior in terms of releasing or eliminating the aggregated developer particles, so that the aggregated particles pass through the nip. Accordingly, even when an intermittent operation is conducted, a satisfactory performance can not necessarily be obtained, and image soilage and black spots are caused, so that the image quality is deteriorated. Further, in the case of the aforementioned layer thickness regulating means, contacting pressure must be balanced, so that the rotating and contacting mechanisms become complicated.

In the apparatus of (a)-(d) and (g), the contacting area of the layer thickness regulating means is relatively large, so that the following inconvenience is caused: in the case of a usual developing unit in which the amount of developer supplied to the nip varies momentarily, the developer layer thickness is influenced by the variation of the amount of developer supplied to the nip.

In the cases of (c) and (d), a developer carrying member preferable for one-component non-magnetic developer is provided with resilience, and a developer layer thickness regulating member is contacted with the developer carrying member with pressure so that a thin developer can be formed. In this case, the developer carrying member tends to be permanently deformed, and the elastic modulus of the developer layer thickness regulating member tends to vary when it is used over a long period of time, so that a thin developer layer can not be stably formed.

In the case of apparatus (e) which has been developed for two-component developer, the apparatus can not maintain performance satisfactorily when it is utilized over a long period of time.

In the apparatus of (a), (b), (e), (f), (g) and (h), a resilient developer layer thickness regulating plate is contacted with a rigid developer carrying member (which is a metallic developer carrying member) with pressure, so that a thin developer layer is formed. When the aforementioned apparatus is used over a long period of time, the elastic modulus of the resilient plate is varied, and the shape of the plate is permanently deformed, so that the durability of the layer thickness regulating member is short. Further, even when the resilient plate is displaced a little from the correct position in the process of assembly, the play provided to the edge of the resilient plate and the contacting force are varied, so that it is difficult to regulate the layer thickness stably. Therefore, this apparatus is disadvantageous in that: when the layer thickness regulating means is assembled in mass-production, the accuracy must be severely maintained.

In the case of apparatus (f), toner aggregation can be released by the interaction between a magnet provided on the back of the developer layer and that provided inside the developer carrying member. However, attraction force is activated through a solid-plate-shaped regulating member. Accordingly, when the distance between the magnets is increased, the attraction force is sharply decreased, so that the contacting force is lowered, that is, contacting force is fluctuated by the variation of the distance between the magnets. Therefore, the developer layer can not be stably pressed by the layer thickness regulating member so as to form a uniform layer, and the aggregation of toner or developer passes through the thickness regulating member. On the contrary, a constant layer thickness can not be obtained, and clogging occurs, so that white streaks are caused in the obtained image which deteriorate the image quality.

SUMMARY OF THE INVENTION

It is a primary object of the present invention to provide a developer layer forming method characterized in that: in order to stably obtain an image of high quality, a developer layer of uniform thickness is stably formed on a developer carrying member; and aggregated developer and toner can be prevented from moving to a developing region.

The second object of the present invention is to provide a developing method by which an excellent image of high sharpness and resolution can be obtained in contact development non-contact development in which one-component or two-component developer is used, and to provide a developing method in which a certain developing condition is determined.

By a developer layer forming method according to the present invention, a developer layer is formed and held on a rotating developer carrying member by forming a predetermined gap between the developer carrying member and a developer layer regulating member in such a manner that: the developer including spacer particles having the same diameter, is passed through a nip position formed between the developer carrying member which carries developer on its cylindrical circumferential surface, and the developer layer regulating member which presses the outer circumferential surface of the developer carrying member to regulate the thickness of developer.

Another developer layer forming method according to the present invention is characterized in that: the aforementioned developer is a two-component developer composed of magnetic carrier and toner containing the aforementioned spacer particles; and the diameters of the aforementioned particles are larger than the maximum diameter of the aforementioned carrier particles.

A further method according to the present invention is characterized in that: the aforementioned developer is composed of the aforementioned spacer particles and one-component developer; and the diameters of the aforementioned spacer particles are larger than the maximum diameter of the particles of the aforementioned one-component developer.

The aforementioned spacer particles are preferably magnetic particles. A portion of the aforementioned developer layer thickness regulating member which comes into contact with the aforementioned spacer particles with pressure, is a rigid or resilient member.

The aforementioned developer carrying member is a rotating metallic sleeve, and preferably a non-magnetic sleeve, and a magnetic field generating means is installed inside the developer carrying member.

The developer layer thickness regulating member according to the present invention is made of a ferromagnetic body, and the aforementioned spacer particles are pushed to the aforementioned developer carrying member by the developer layer thickness regulating means by the action of magnetic force.

In another method, the aforementioned spacer particles are pushed to the aforementioned developer carrying member by the developer layer thickness regulating means by the action of mechanical force.

In a further method, the aforementioned spacer particles are pushed to the aforementioned developer carrying member by the developer layer thickness regulating means by the action of both magnetic and mechanical force.

By a non-contact developing method according to the present invention, development is conducted as follows: In a non-contact developing method by which a latent image on an image carrier is developed by means of non-contact development in an alternating electrical field, using a thin layer of two-component developer formed on a developer carrying member, a thin layer of developer is formed on the developer carrying member when a two-component developer containing magnetic spacer particles, the diameters of which are larger than those of the carrier particles of the two-component developer, are held and passed through a gap formed between the developer carrying member which carries two-component developer on its rotating cylindrical circumferential surface, and a developer layer thickness regulating member which is provided facing the developer carrying member so as to regulate the developer thickness. The formed thin layer of developer is carried to a developing region, and develops an electrostatic latent image formed on an image carrier, the developing gap of which is larger than the aforementioned developer layer thickness, by means of non-contact development.

By another non-contact developing method according to the present invention, a thin developer layer is formed when the aforementioned spacer particles contained in the two-component developer adhered onto the developer holding surface of the aforementioned rotating developer carrying member, are pressed by the aforementioned developer layer thickness regulating member.

By a further method according to the present invention, a latent image on the image carrier opposed to a thin layer of two-component developer formed on the developer carrying member, is developed by means of non-contact development while an alternating electrical field is formed in a developing gap in the aforementioned developing region.

In a further non-contact developing method according to the present invention, development is conducted as follows: In a non-contact developing method by which a latent image on an image carrier is developed by means of non-contact development in an alternating electrical field, using a thin layer of one-component developer formed on a developer carrying member, a thin layer of developer is formed on the developer carrying member when a one-component developer containing magnetic spacer particles, the diameters of which are uniform, is held and passed through a gap formed between the developer carrying member which carries one-component developer on its rotating cylindrical circumferential surface, and a developer layer thickness regulating member which is provided facing the developer carrying member so as to regulate the developer thickness. The formed thin layer of developer is carried to a developing region, and develops an electrostatic latent image formed on an image carrier, the developing gap of which is larger than the aforementioned developer layer thickness, by means of non-contact development.

By another non-contact developing method according to the present invention, a thin developer layer is formed when the aforementioned spacer particles contained in the one-component developer adhered onto the developer holding surface of the aforementioned rotating developer carrying member, are pressed by the aforementioned developer layer thickness regulating member.

By a further method according to the present invention, a latent image on the image carrier opposed to a thin layer of one-component developer formed on the developer carrying member, is developed by means of non-contact development while an alternating electrical field is generated in a developing gap in the aforementioned developing region.

The present invention is to provide developing method characterized in that: two-component developer including a mixture of magnetic carrier and resinated toner, and magnetic spacer particles, the diameters of which are larger than those of the aforementioned carrier, are supplied onto a rotating developer carrying member; the thickness of the developer is regulated by a developer layer thickness regulating member being pressed to the developer holding surface of the aforementioned developer carrying member while the developer is being conveyed; and an electrostatic latent image formed on an image carrier which is opposed to the developer carrying member forming a predetermined gap, is developed in a developing region by the aforementioned developer by means of contact developing so that a toner image is formed, wherein a thin uniform developer layer is formed on the developer carrying member in such a manner that the two-component developer containing the aforementioned spacer particles is conveyed by the aforementioned developer carrying member, and when the aforementioned spacer particles pass through the contacting position of the developer carrying member and the developer layer thickness regulating member, the gap between the developer carrying member and the developer layer thickness regulating member is controlled to a predetermined value so that a uniform thin developer layer can be formed.

According to another contact developing method of the present invention, an AC bias is impressed between the developer carrying member and the image carrier so as to restrict the spacer particles and carrier to the surface of the developer carrying member in the developing region, and to make it possible to move the toner to the surface of the image carrier.

The present invention is to provide another developing method characterized in that: one-component developer including magnetic spacer particles, the diameters of which are larger than those of the magnetic carrier, are supplied onto a rotating developer carrying member; the thickness of the developer is regulated by a developer layer thickness regulating member being pressed to the developer holding surface of the aforementioned developer carrying member while the developer is being conveyed; and an electrostatic latent image formed on an image carrier which is opposed to the developer carrying member forming a predetermined gap, is developed in a developing region by the aforementioned developer by means of contact developing so that a toner image is formed, wherein a thin uniform developer layer is formed on the developer carrying member in such a manner that the one-component developer containing the aforementioned spacer particles is conveyed by the aforementioned developer carrying member, and when the aforementioned spacer particles pass through the contacting position of the developer carrying member and the developer layer thickness regulating member, the gap between the developer carrying member and the developer layer thickness regulating member is controlled to a predetermined value so that a uniform thin developer layer can be formed.

According to another contact developing method of the present invention, an AC bias is impressed between the developer carrying member and the image carrier so as to restrict the spacer particles to the surface of the developer carrying member in the developing region, and to make it possible to move the toner to the surface of the image carrier.

DESCRIPTION OF THE PREFERRED EMBODIMENTS

With reference to the attached drawings, an embodiment of the present invention will be explained as follows.

Figure 4:
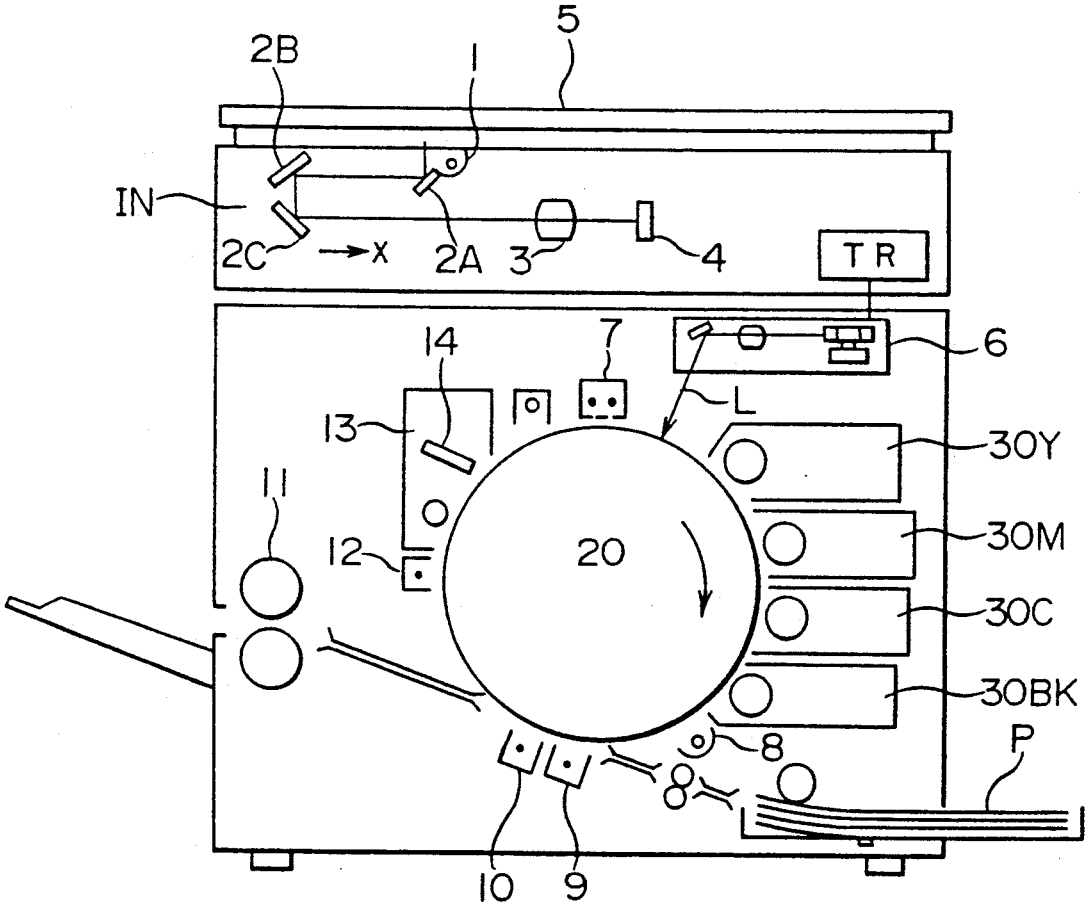
FIG. 4 is a view showing the structure of an embodiment in which the developing method of the present invention is applied to a multi-color image forming apparatus.

FIG. 4 is a view showing the structure of an embodiment in which the developer layer forming method of the present invention is applied to a multi-color image forming apparatus.

In the drawing, image input section (reading system) IN includes an illuminating lamp 1, mirrors 2A, 2B, 2C, a lens 3, and a one dimensional color CCD image sensor 4, which are integrally formed into one unit. The mirrors 2A, 2B, 2C, and illuminating lamp 1 are moved in the direction of arrow mark X by a drive unit not shown in the drawing so as to conduct a scanning operation, and the CCD image sensor 4 reads out a document image. The document image may be read out in such a manner that: the aforementioned image input section IN is fixed and a platen 5 is moved.

Image information which has been read out by image input section IN, is converted into data appropriate for recording by image processing section TR.

The aforementioned image information signal is inputted into an optical laser system 6. The optical laser system 6 includes a semiconductor laser beam generator, polygonal mirror, and $f\theta$ lens, which are formed into one unit. According to the aforementioned image data, a latent image is formed on an image carrier 20 by the optical laser system 6, and the latent image is developed and a toner image is formed on the image carrier 20. The surface of the image carrier 20 is uniformly charged by a scorotron charging electrode 7. Then, the image carrier 20 is irradiated with image exposure light L sent from the optical laser system 6 in accordance with recording data. In the manner described above, an electrostatic latent image is formed on the image carrier 20. This electrostatic latent image is developed by developing unit 30Y in which yellow toner is provided. The image carrier 20 on which the toner image has been formed, is uniformly charged again by the scorotron charging electrode 7, and irradiated with image exposure light L in accordance with recording data of another color component. The formed latent image is developed by developing unit 30M in which magenta toner is provided. As a result, a toner image of two colors of yellow and magenta is formed on the image carrier 20. In the same manner, a cyan toner image is formed by a developing unit 30C in which cyan toner is provided, and a black toner is formed by a developing unit 30Bk in which black toner is provided, and the formed toner images are superimposed successively, so that a 4-color toner image is formed on the image carrier 20.

Thus obtained multi-color toner image is discharged by a discharge lamp 8 so that a transfer operation can be easily conducted, and transferred onto recording paper P by a transfer electrode 9. After that, recording paper P is separated from the image carrier 20 by a separation electrode 10, and fixed by a fixing unit 11. The image carrier 20 is then cleaned by a discharge electrode 12 and a cleaning unit 13.

The cleaning unit 13 is provided with a cleaning blade 14, which is separated from the surface of the image carrier 20 during image formation. After a multi-color image formed on the image carrier has been transferred onto a transfer sheet such as a paper, the cleaning blade 14 comes into contact with the image carrier 20 and scrapes off the residual toner on the image carrier. Then, the cleaning blade 14 is separated from the surface of the image carrier 20.

Figure 2:
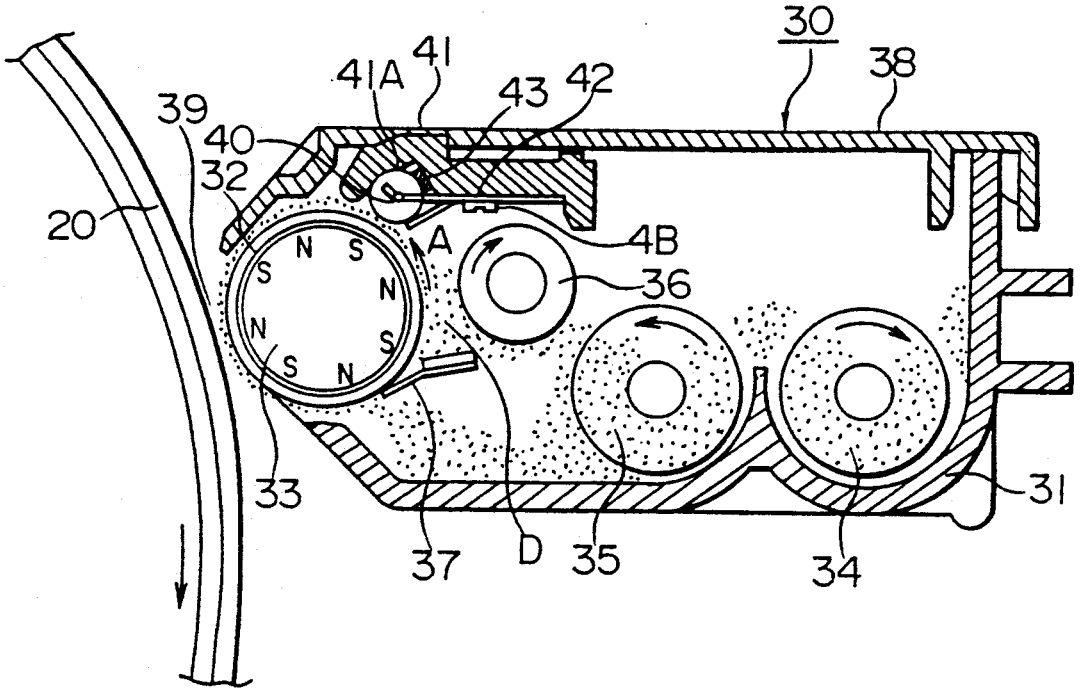
FIG. 2 is a sectional view of the aforementioned developing unit.

The aforementioned developing units 30Y, 30M, 30C, and 30Bk have the same structure, and a typical one is shown by a sectional view in FIG. 2.

A developing sleeve 32, magnetic roller 33, toner conveyance member 34, toner scraping member 35, supply roller 36, and scraper 37 are installed inside a housing 31 of the developing unit 30. Inside a cover member 38 which closes an upper opening of the aforementioned housing 31, a developer layer thickness regulating means is provided which comprises a developer layer thickness regulating member (a thin layer forming rod) 40 made of a stainless steel rod to regulate the thickness of developer, a holder 41 which holds the thin layer forming rod 40, a mounting plate 42, and a resilient member 43 which pushes the aforementioned thin layer forming rod 40.

A gap formed between the aforementioned developing sleeve 32 and the image carrier (the photoreceptor drum) 20 is always maintained constant, and more specifically the gap is maintained to be about 0.5 mm, when rollers (not shown in the drawing) provided to the end portions of the developing sleeve 32 come into contact with the circumferential surface of the image carrier 20, wherein the contact portion is located close to both edges of the image carrier 20 outside the image forming region.

Toner is supplied from a toner container (a toner hopper), which is not shown in the drawing, and sent to a toner conveyance member 34. Then, the supplied toner is sufficiently stirred and mixed with two-component developer D including magnetic carrier and toner which are previously provided in the housing 31, by the toner conveyance member 34 and stirring member 35 which are rotated in the opposite direction to each other. After that, the mixed developer is sent to the developing sleeve 32 through a supply roller 36. The aforementioned toner conveyance member 34 and stirring member 35 are screw-shaped members having a left-handed screw rotated in the opposite direction to each other. Toner and carrier are conveyed by the conveyance member 34 inside the housing 31 to the opposite side with regard to the viewer, and get over a partition of the housing 31, the upper edge of which is inclined toward the opposite side from the viewer, so that the toner and carrier are moved to the side of the stirring member 35 and conveyed to the viewer's side. While the toner and carrier are mixed in the aforementioned manner, triboelectric charging is conducted and uniform developer D is made. Developer D is scattered on the circumferential surface of the developing sleeve 32 by the supply roller 36.

A magnetic roller 33 having a fixed magnetic pole, is installed inside the rotating developing sleeve 32. By the action of the rotating developing sleeve 32 and the magnetic roller 33, developer D is adhered onto the surface of the developing sleeve 32 and conveyed in the direction of an arrow mark A and passes through the pushing position of the aforementioned thin layer forming rod 40 so that a predetermined thin layer can be formed.

Figure 3:
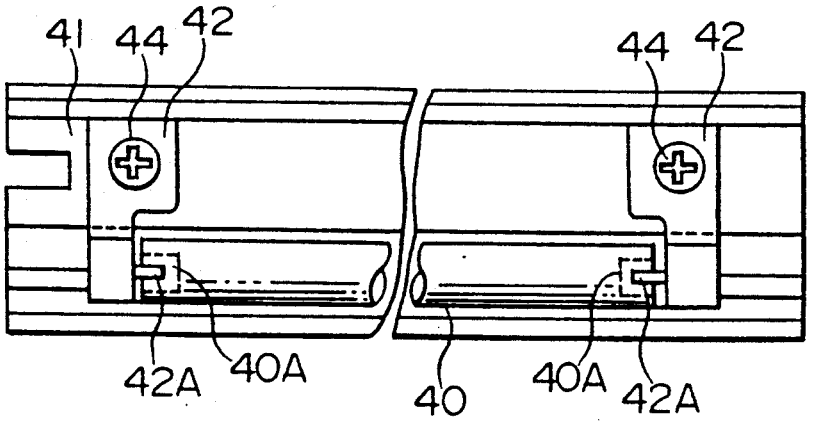
FIG. 3 is a plan view of a developer layer thickness regulating means.

FIG. 3 is a plan view of the developer layer thickness regulating means. A plurality of resilient members 43 are adhered onto a portion of the inner wall of a V-shaped groove 41A of the aforementioned holder 41. The aforementioned thin layer forming rod 40 is set into the cut-out portion formed by the aforementioned resilient member 43 and V-shaped groove 41A. A tip of the protruded portion 42A provided to a curved portion of the mount plate 42, is inserted into center holes 40A, 40A formed at both edges of the thin layer forming rod 40. The mount plate 42 is positioned in such a manner that the mount plate 42 is bumped against the reference surface of the aforementioned holder 41, and then the mount plate 42 is fixed to the holder 41 by a screw 44. Due to the foregoing, the thin layer forming rod 40 does not come off from the holder 41. Of course, the engagement of the aforementioned protruded portion 42A and the center hole 40A is loose, and an appropriate clearance is made so that the thin layer forming rod 40 does not come off.

The unit of the developer layer thickness regulating means assembled in the aforementioned manner, is fixed to the cover member 38 of the developing unit 30, and then the cover member 38 is set on the housing 31. In the manner described above, both adjustment and assembly are completed.

The polarity of the aforementioned magnetic thin layer forming rod 40 is reverse to that of the magnetic roller 33 which is opposed to the rod 40. The magnetic thin layer forming rod 40 is pressed against the developing sleeve 32 by the magnetic attraction force and the resilient force generated by the aforementioned resilient member 43. A predetermined uniform developer layer thickness can be obtained by the aforementioned device in such a manner that: developer D carried on the developing sleeve 32 pushes up the thin layer forming rod 40 against the force given by the aforementioned magnetic thin layer forming rod 40 and the resilient member 43; and developer D passes through a gap formed in the contact position of the developing sleeve 32 and the thin layer forming rod 40 so that a developer layer of uniform thickness can be obtained. An optimal developing operation can be conducted by the uniform developer layer in cooperation with a gap formed between the image carrier 20 and the developing sleeve 32 in the developing region. In this case, the gap is set to 0.8 mm.

After a developing operation has been completed, residual developer D on the developing sleeve 32 is returned into the housing 31 and scraped off from the circumferential surface of the developing sleeve 32. Then, the scraped toner is stirred uniformly by the stirring rollers 34, 35. After that, the toner is scattered on the developing sleeve 32 by the supply roller 36 so that the developing operation is conducted continuously.

For example, an experiment was conducted under the following conditions: In the aforementioned developer layer thickness regulating means, the thin layer forming rod 40 was made of a rigid and magnetic stainless steel rod, the diameter of which was 6 mm, and the thin layer forming rod 40 was located in a position opposed to the magnetic poles of the magnetic roller 33 and a load of 2–6 gf/mm was given.

As a result, a developer conveyance amount of 7–9 $mg/cm^2$ was obtained in the experiment in which developer for model DC-8028 (made by Konica Corporation) was used.

In this experiment, the magnetic flux density was 600 gauss at the contact position on the surface of the developing sleeve 32.

Figure 5:
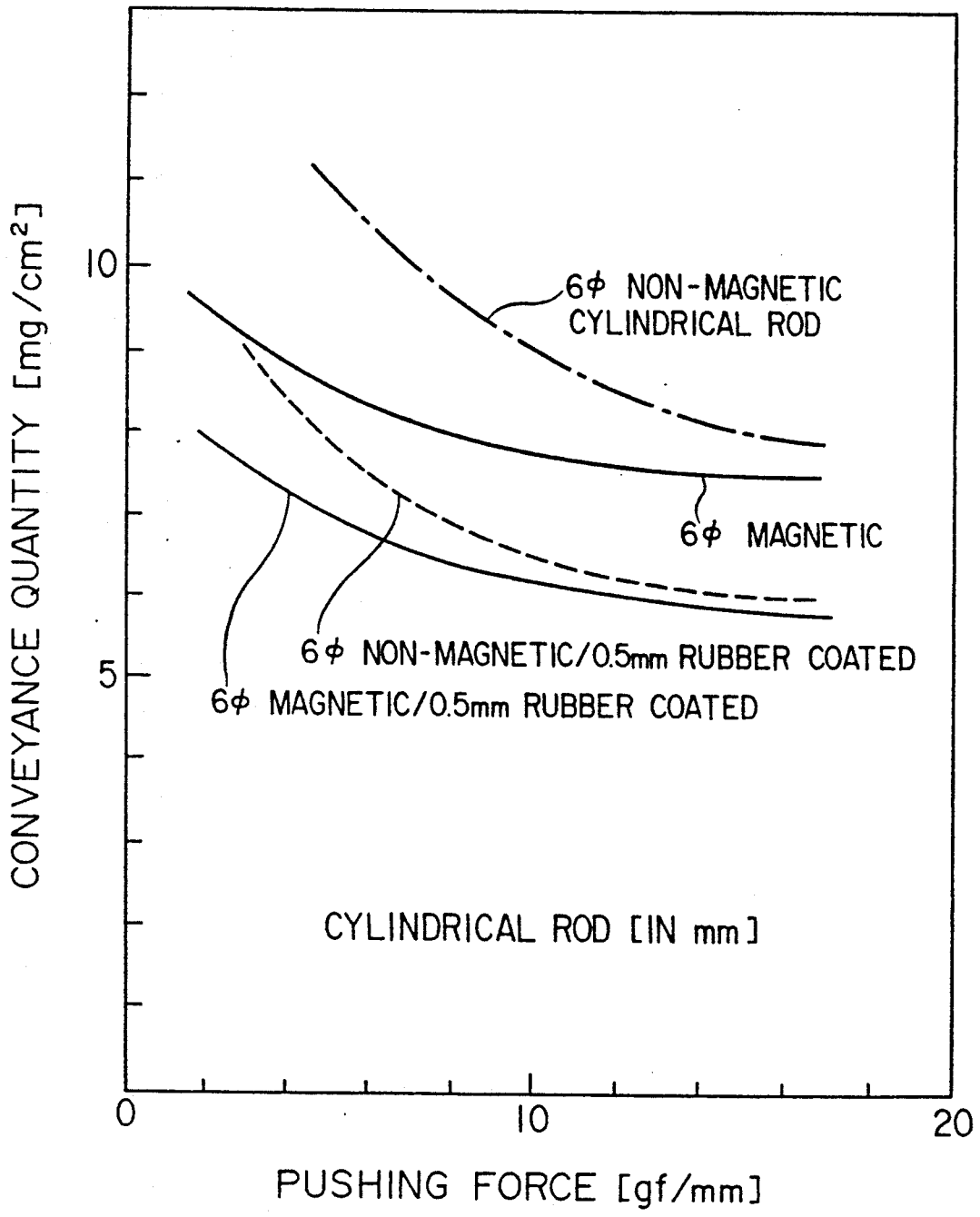
FIG. 5(A) and FIG. 5(B) are graphs showing the relations between pushing force of a thin layer forming rod and conveyance quantity of developer.
Figure 5:
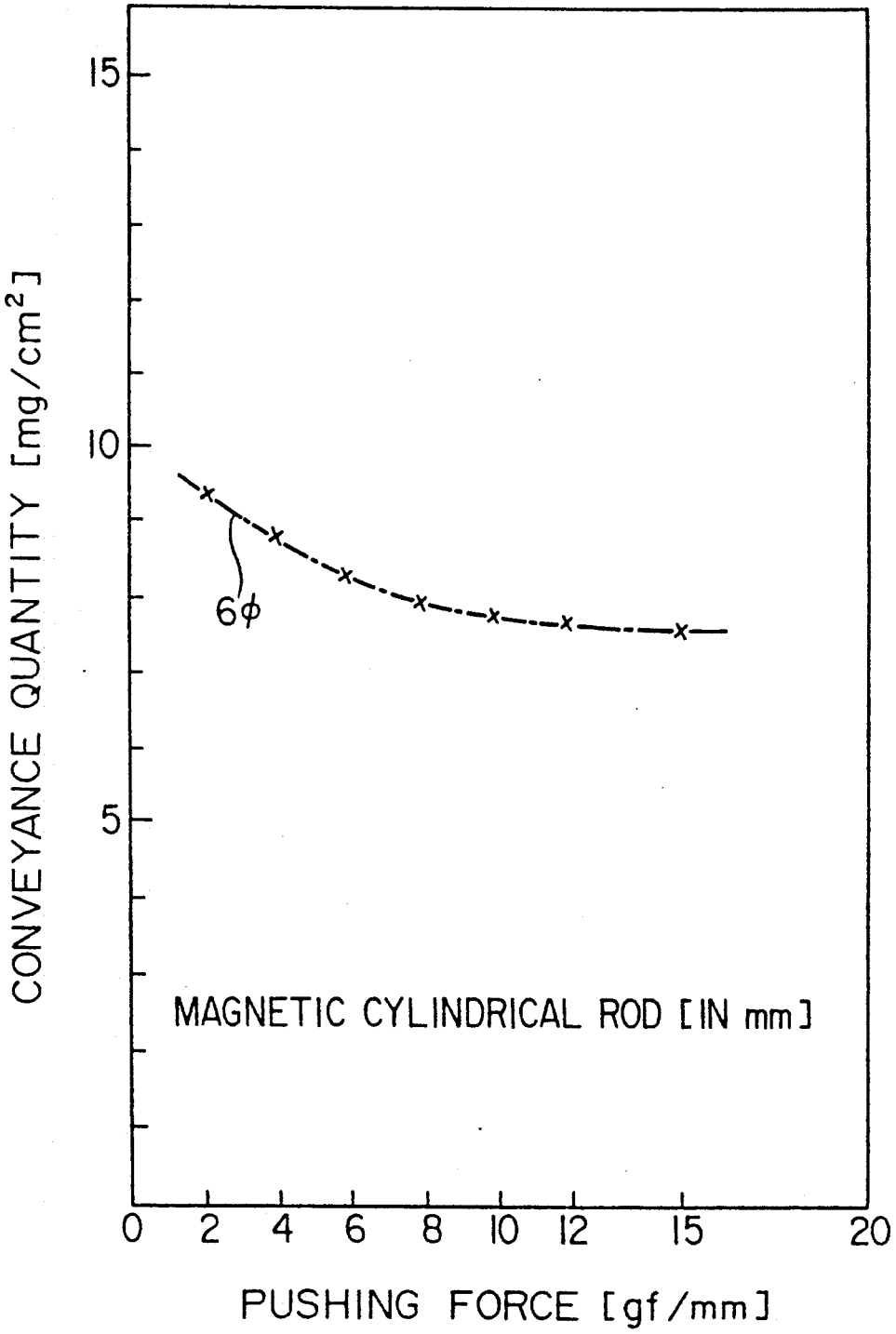

FIG. 5(A) shows a result of comparison of the developer conveyance amount (which is the weight of developer per unit area on the surface of the developing sleeve), that is, the developer layer thickness, in the case where a non-magnetic rigid cylindrical rod coated with rubber, the diameter of which is 6 mm, is used instead of the aforementioned magnetic thin layer forming rod 40.

FIG. 5(B) shows a relation between the pressure and the developer conveyance amount in the case in which a rigid and magnetic thin layer forming rod 40 is used, wherein the diameter of the thin layer forming rod 40 is varied.

Further, even when a non-magnetic stainless pipe, a metallic pipe made of aluminum, and a rigid pipe made of hard resin, glass and ceramic, are used for the rigid developing sleeve 32, the developer conveyance amount is varied in accordance with the variation in the pushing force.

Variation in the developer conveyance amount is caused by roughness of the surface of the developing sleeve 32.

In the case where one-component developer is used, when the pushing force of the thin layer forming rod 40 is increased, the developer conveyance amount per unit area on the developing sleeve 32, that is, the developer layer thickness is maintained constant in spite of the fluctuation in pushing force.

On the other hand, when the pushing force is weak, the conveyance amount of developer per unit area is increased. However, the conveyance amount becomes unstable and greatly varies due to the fluctuation of pushing force.

Consequently, it is necessary to increase the pushing force of the thin layer forming rod in order to obtain a stable developer conveyance amount. However, when the pushing force is increased, an excessive load is given to the toner, so that toner deterioration is increased.

Therefore, an increase in pushing force can be a cause of toner deterioration, and toner may adhere onto the surface of the developing sleeve 32 and the developer to become aggregated.

Variation in developer conveyance amount is caused by roughness of the surface of the developing sleeve 32.

FIG. 1(A) is an enlarged sectional view of the essential portion of the aforementioned developing unit 30.

FIG. 1(B) is an enlarged sectional view showing an embodiment to which the developer layer thickness forming method of the present invention is applied.

Developer D relating to the present invention includes magnetic carrier C coated with resin, resin toner T containing a coloring agent, and spacer particle S coated with resin, and the details are shown in the following table.

TABLE 1

| Developer | Particle Size (Averaged by Weight) | Shape | Coating Material | Core | Magnetization |
|---|---|---|---|---|---|
| Spacer Particle (S) | 60 μm | Spherical | Styrene-acrylic Resin 2 μm thick | Ferrite | 15 emu/g |
| Carrier (C) | 20 μm | Spherical | Styrene-acrylic Resin 2 μm thick | Ferrite | 20 emu/g |
| Toner (T) | 3.5 μm | — | — | — | — |

Objective developer D is obtained in such a manner that 88 weight parts of carrier (C) and 12 weight parts of toner (T) shown in the above table, are mixed with each other; and the obtained mixture is mixed with spacer particles (S), the diameter of which is the same. A ratio of spacer particles S to the total of carrier C, toner T and spacer particles S, is about 6%. As shown in Table 1, the diameter of spacer particles S is 2–8 times as large as that of carrier C.

In this embodiment, the developer layer formed on the circumferential surface of the developing sleeve 32 is controlled to a predetermined thickness in such a manner that; when developer D adhered onto the circumferential surface of the developing sleeve 32 rotating in the direction of an arrow around the fixed magnetic roller 33, passes through the contact position of the aforementioned thin layer forming rod 40, the thickness of the developer layer is restricted by a gap g between the developing sleeve 32 and the thin layer forming rod 40, wherein the gap is determined by the aforementioned spacer particle S so that spacer particle S can pass through the gap g. In this case, the diameter of the aforementioned spacer particle S is selected so that it can be appropriate for the developing condition of the developing unit 30, and gap g is regulated by particle S, and a desired developer layer thickness can be formed.

In the developing region 39, an electrostatic latent image on the image carrier 20 rotating in the direction of an arrow in the drawing, is developed by the aforementioned developer layer by means of non-contact development, and a toner image is formed. In this non-contact developing process, a developing bias including an AC-component is impressed upon the aforementioned developing sleeve 32 by an electric power source not illustrated in the drawing. As a result, only toner in the developer adhered onto the developing sleeve 32 is selectively moved and adhered onto the surface of the aforementioned latemt image.

Developer D, the toner component of which has been consumed so that the ratio of carrier is increased, is conveyed by the developing sleeve 32, and scraped off from the developing sleeve 32 by the scraper 37. Then, developer D is mixed with new developer, the toner ratio of when is high.

In the aforementioned developing process, magnetic spacer particles S are attracted by magnetic force onto the circumferential surface of the developing sleeve 32 and conveyed. After that, spacer particles S are scraped off from the surface of the developing sleeve 32, and mixed with developer D in the housing 31 so that it can be used repeatedly.

Preferably mechanical properties of 2-component developer D utilized in the aforementioned developing unit 30 are shown in the following Table 2.

TABLE 2

| | Carrier (Large Size) (≈ Diameter of Spacer Particle) | Carrier (Small Size) | Ratio of Carrier (Large Size) to Carrier (Small Size) |
|---|---|---|---|
| Diameter of Particle (Averaged by Weight) | 30–150 μm | 15–50 μm | 0.01–0.5 |
| Magnetization | 5–30 emu/g | 10–25 emu/g | |
| Specific Resistance | Not less than $10^8$ Ωcm | Not less than $10^8$ Ωcm | |
| Shape | Spherical | | |

The thickness of the aforementioned developer layer is 100 μm–450 μm, so that the gap formed between the image carrier 20 and the developing sleeve 32, that is, the development gap, can be reduced to about 300 μm to conduct non-contact development. When the development gap is reduced in the aforementioned manner, the intensity of the electric field formed in the developing region 39 is increased. Accordingly, a narrow development gap is advantageous in that: development can be sufficiently performed even though the development bias impressed upon the development sleeve 32 is low; and leakage of the development bias can be reduced. Further, the quality of obtained images such as resolution, can be generally improved.

In order to improve image quality, it is effective to reduce the development gap. However, when the tip of a carrier brush is formed too close to the surface of the image carrier 20, carrier is too easily adhered onto the surface, so that there is a limit. The minimum value of the gap is approximately 300 μm which has been described before.

The inventors have found a condition under which excellent reproducibility can be obtained, with regard to a device similar to the aforementioned developing unit, in such a manner that an AC-component $V_{AC}$ of development bias, a DC-component $V_B$ of development bias, development bias frequency nkHz, and electrical potential $V_H$ of a on-image portion of the image carrier 20, are changed in the range shown in Table 3.

TABLE 3

| | | |
|---|---|---|
| Developing Sleeve (32) | Outside Diameter | 10–40 mmϕ |
| | Rotation Speed | 100–400 rpm |
| | Amount of Adhered Developer | 1–10 mg |
| Magnetic Roller (33) | Number of Poles | 6–12 poles |
| | Rotation Speed | 100–150 rpm |
| | Magnetic Force (Sleeve Surface) | 400–800 G |
| Photoreceptor (20) | Surface Potential | 200–1500 V |
| Process Speed | | 50–300 mm/s |
| Development Gap (g) | | 0.3–0.6 mm |

In the experimental process, the following tendencies were recognized.

(1) It is preferable that the value of $|VH-VB|$ is low. When the value is high, carrier deposition tends to be caused in the non-image section. However, when the value is close to 0, fogging occurs.

(2) In the case of deterioration or fatigue of the photoreceptor, surface potential $V_H$ of the photoreceptor fluctuates, so that it is desirable that surface potential $V_H$ is set high.

(3) When $V_{AC}$ is high, a leak of electric current occurs, and carrier is deposited, so that it is preferable that $V_{AC}$ is low.

Other than the aforementioned general tendencies, it was made clear that there is a specific relation between $|V_H-H_B|$ and development bias frequency (kHz), and between impressed AC voltage $V_{AC}$ and image quality. In this case, $|V_H|>|V_B|$ is a condition of reversal development, and $|V_H|<|V_B|$ is a condition of normal development.

Figure 13:
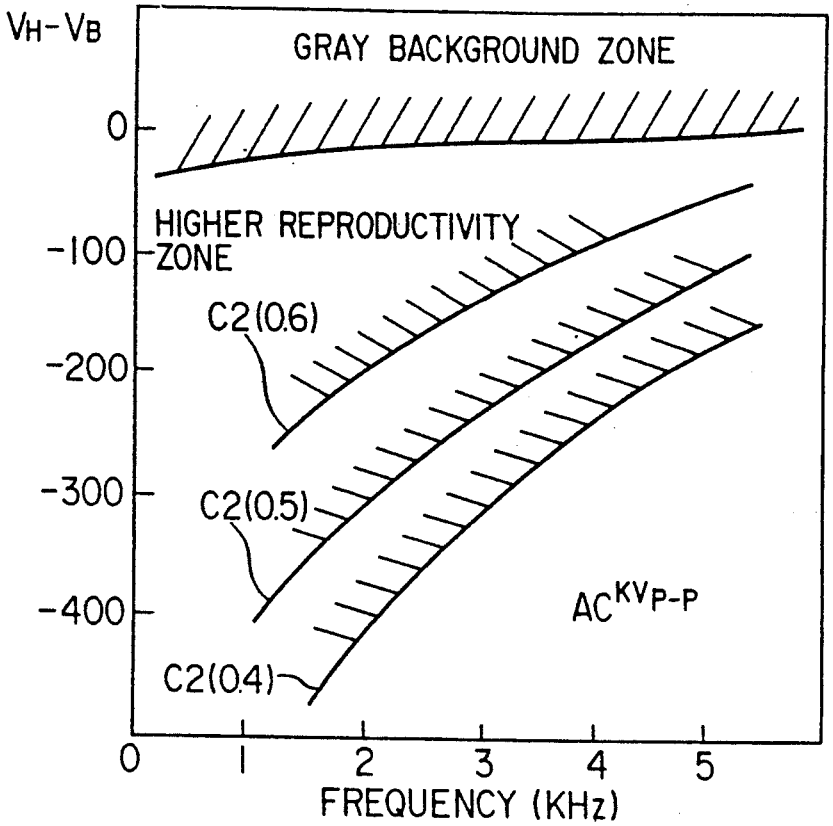
FIG. 13 and FIG. 14 are characteristic diagrams of an alternating electrical field and electrical potential on an image carrier, resulting from an A.C. bias voltage.

FIG. 13 is a graph showing a range in which excellent reproducibility can be provided, wherein the horizontal axis represents developing bias frequency (kHz) and the vertical axis represents a value of $|V_H-|V_B|$. In this graph, the AC-component of the developing bias is set to 2 $KV_{pp}$. In FIG. 13, C2(0.6), C2(0.5), C2(0.4) respectively represent the limits within which excellent reproducibility can be obtained when the development gap is set to 0.6 mm, 0.5 mm, and 0.4 mm.

Figure 14:
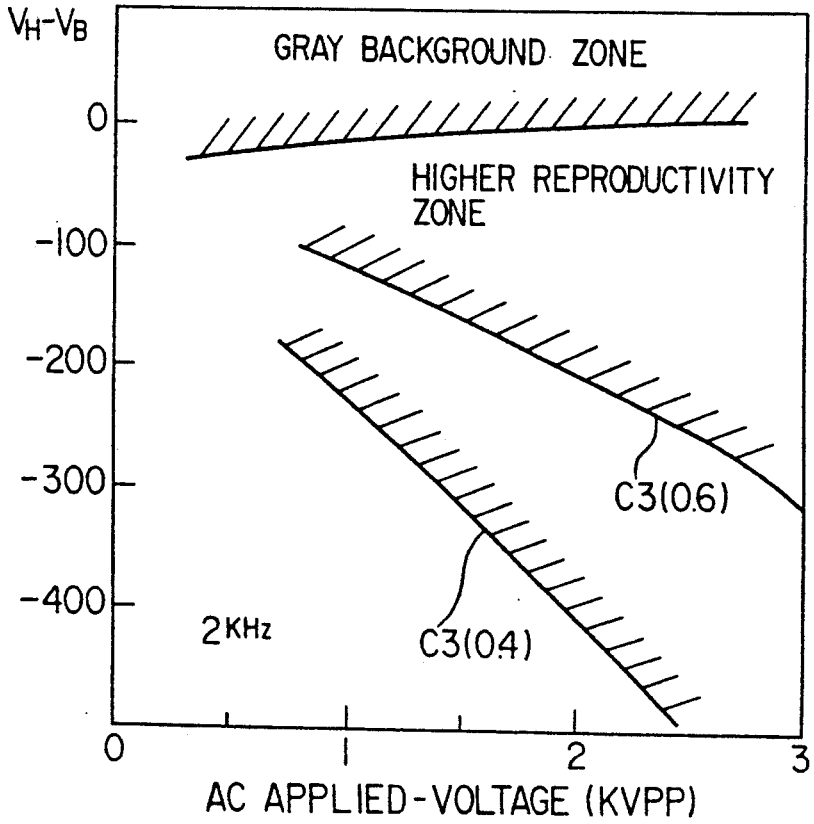

FIG. 14 shows a range in which excellent reproducibility can be obtained, wherein the horizontal axis represents an impressed AC voltage ($KV_{pp}$) of development bias, and the vertical axis represents $|V_H-|V_B|$. In this case, development bias frequency is set to 2 KHz. In this graph, the AC-component of the developing bias is set to 2 KVpp. In FIG. 14, C3(0.6), C3(0.4) respectively represent the limits within which excellent reproducibility can be obtained when the development gap is set to 0.6 mm and 0.4 mm. From FIG. 13 and FIG. 14, it is clear that: when the development gap is small, there is a wide range in which reproducibility is excellent. The critical lines indicated by C2(0.6), C2(0.5), C2(0.4) in FIG. 13, show a characteristic in which $V_H$–$V_B$ increases as the frequency is increased. The critical lines indicated by C3(0.6), C3(0.4) in FIG. 14, show a characteristic in which $V_H$–$V_B$ decreases as the AC applied voltage is increased.

In order to find the aforementioned critical lines, a region in which reproducibility was excellent was defined by the following inequality, and the value of F was found experimentally. The obtained data is shown in Table 4.

TABLE 4

$$0 < \frac{|V_H - V_B|}{V_{AC}} < F$$

F-value

| DEVELOPMENT GAP (MM) | DEVELOPMENT BIAS FREQUENCY (KHz) 2 | 3 | 4 | 5 |
|---|---|---|---|---|
| 0.3 | 0.24 | 0.19 | 0.16 | 0.11 |
| 0.4 | 0.20 | 0.15 | 0.12 | 0.08 |
| 0.5 | 0.15 | 0.10 | 0.08 | 0.05 |
| 0.6 | 0.10 | 0.06 | 0.04 | 0.02 |

Equation $$F = \frac{F_0}{nH}$$

is set, wherein the bias frequency is nKHz and the development gap is Hmm. Then, the value of $F_0$ can be found from the experimental data of Table 4 as shown in Table 5.

When the frequency of $V_{AC}$ is varied, the following phenomena occur: In a low frequency region (lower than 1 KHz), fogging tends to occur, and carrier deposition is remarkably increased. In a high frequency region (higher than 5KHz),the applicable range is reduced, so that the characteristic is not adequate to follow changes of the photoreceptor characteristic caused by fluctuation in the the environment. Due to the foregoing, the frequency of $V_{AC}$ is preferably set to 1–5 KHz, and more preferably set to 2–4 Khz.

TABLE 5

$F_0$-value

| DEVELOPMENT GAP (mm) | DEVELOPMENT BIAS FREQUENCY (KHz) 2 | 3 | 4 | 5 |
|---|---|---|---|---|
| 0.3 | 0.14 | 0.17 | 0.19 | 0.17 |
| 0.4 | 0.16 | 0.18 | 0.19 | 0.16 |
| 0.5 | 0.15 | 0.15 | 0.16 | 0.13 |
| 0.6 | 0.12 | 0.11 | 0.10 | 0.07 |

Due to the foregoing, the following can be made clear. Non-contact development of high reproducibility can be conducted in the following range.

$$0 < \frac{|VH - VB|}{V_{AC}} < \frac{0.20}{nH}$$

Preferably, the range can be expressed by the following inequality.

$$0 < \frac{|VH - VB|}{V_{AC}} < \frac{0.15}{nH}$$

More preferably, the range can be expressed by the following inequality.

$$0 < \frac{|VH - VB|}{V_{AC}} < \frac{0.06}{nH}$$

The aforementioned conditions show the relation between the development gap and development bias. Under the aforementioned conditions, the edge electrical field is weak, so that sharpness and resolution of not less than 8 l/mm, sufficient for practical use, can be obtained.

Figure 1:
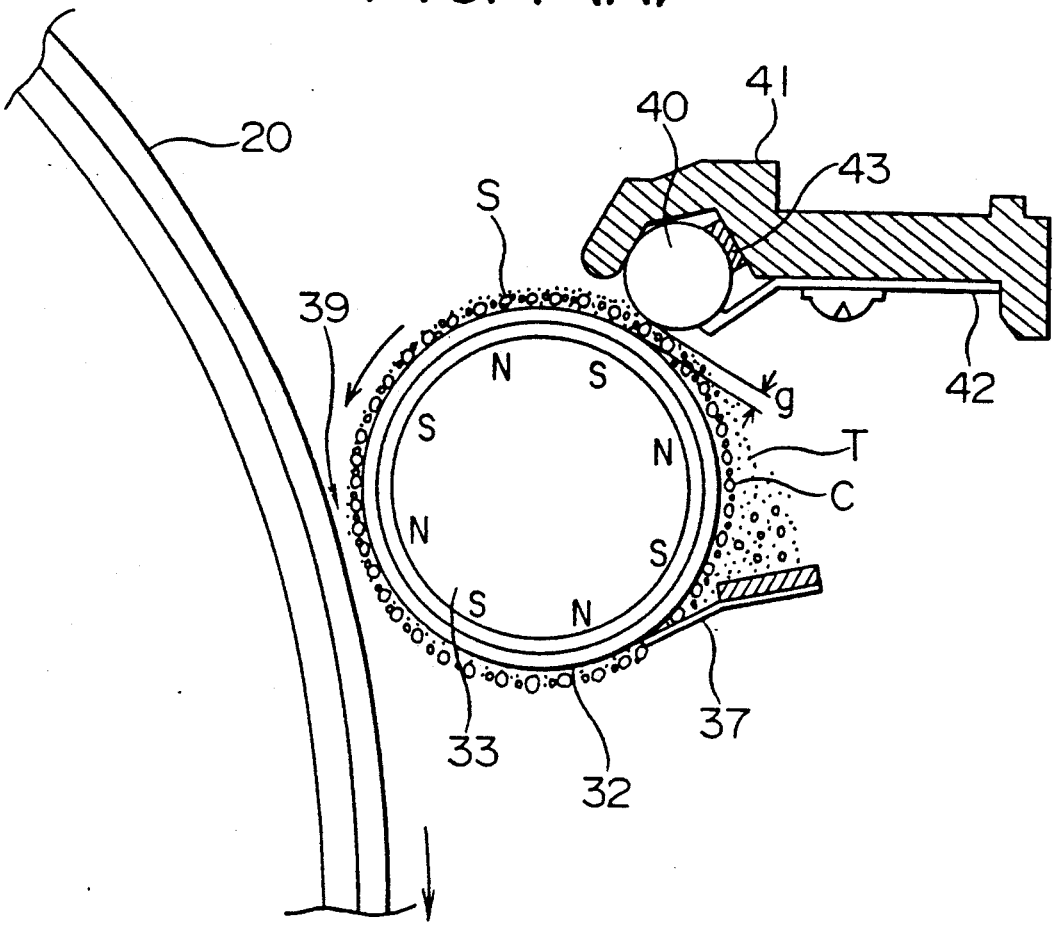
FIG. 1(A) is an enlarged sectional view of an essential portion of a developing unit to which a developer layer forming method according to the present invention is applied.
FIG. 1(B) is an enlarged schematic illustration explaining spacer particles relating to the present invention.
Figure 1:
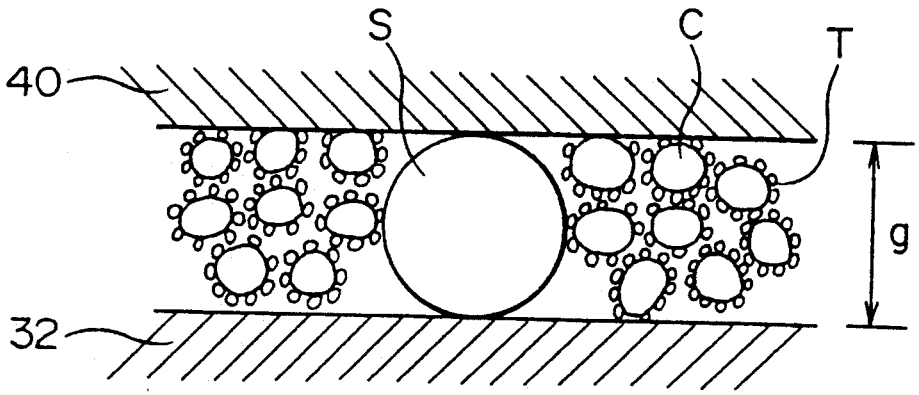

The specification of each member of the apparatus of the embodiment shown in FIG. 1, is as follows.

The aforementioned developing sleeve 32 is a thin cylindrical member made from stainless steel, the outer diameter of which is 20 mm, and the outer circumferential surface is processed by means of honing so that the surface roughness can be 3 μm. The diameter of the developing sleeve 32 is preferably small in order to reduce the size of the developing unit. However, the diameter of the developing sleeve 32 is determined to be 15–30 mm by the restriction of magnetic force of the magnetic roller 33 installed in the developing sleeve.

Various experiments were made in which the rotating speed of the developing sleeve 32 was changed. When the rotating speed was low, supply of developer was small, so the image density was low when latent images were developed. In the case of the developing sleeve 32, the diameter of which was 20 mm, when spacer particles were not used, the maximum image density was linearly increased when the rotating speed was in the range of 0–200 rpm. When the rotating speed was not less than 200 rpm, the image density was saturated. However, when the environmental temperature is low, the maximum image density is lowered, so that it is necessary to set the rotating speed a little higher.

Next, an embodiment in which spacer particles are mixed with developer, is shown in Table 6.

TABLE 6

| | Rotating Speed of Developing Sleeve | | | |
|---|---|---|---|---|
| | 250 rpm | | 100 rpm | |
| Spacer Particle (S) | Contained | Not contained | Contained | Not contained |
| Conveyance Amount mg/cm$^2$ | 12.9 | 8.6 | 12.9 | 8.6 |
| Image Density | 1.35 | 1.15 | 1.30 | 0.80 |
| Durability (Sheet) | Not less than 30000 | 15000 | Not less than 50000 | 20000 |

In this case, the diameter of the spacer particle is 60 μm, the mixing ratio is 6 wt%, and the gap between the developing sleeve 32 and the image carrier 20 is 0.8 mm.

As shown in Table 6, when spacer particles S were mixed with 2-component developer, the developer conveyance, image density and durability of developer could be improved without any relation to the rotating speed of the developing sleeve. That is, even when the developing sleeve is rotated at a low speed, the aforementioned performances can be improved as compared with a case in which spacer particles are not used.

Figure 6:
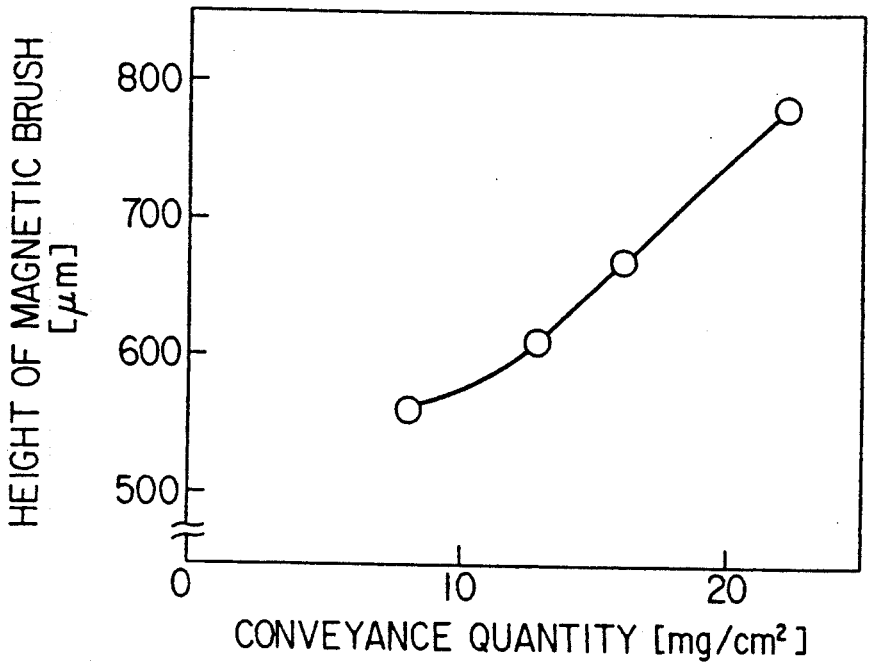
FIG. 6(A) and FIG. 6(B) are characteristic diagrams of developer conveyance quantity.
Figure 6:
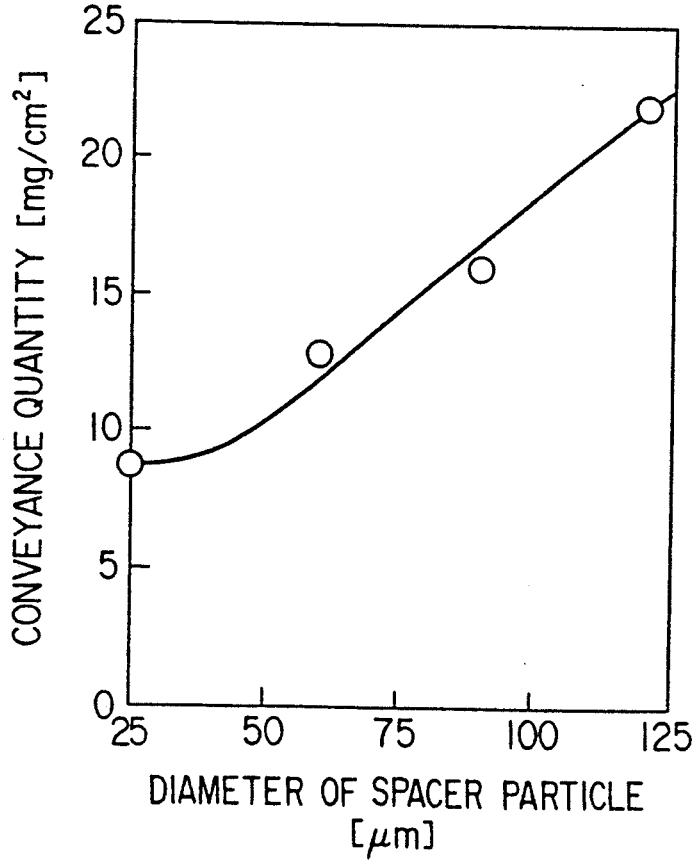

FIG. 6(A) is a graph which shows the relation between the conveyance quantity and the height of the magnetic brush. As illustrated in the graph, as the conveyance quantity is increased, the height of the magnetic brush is varied. In this case, the rate of change is as follows: when the conveyance quantity doubles, the height of the magnetic brush is 1.3 times as much as the original height.

In other words, even when the conveyance quantity of developer is increased, the height of the magnetic brush does not become so high, and the magnetic brush does not come into contact with the image carrier.

FIG. 6(B) is a graph showing the relation between the size of a spacer particle and the conveyance quantity of developer. In the graph, is shown the effect provided to the conveyance quantity when spacer particles S are mixed with developer. That is, when the size of spacer particle S is changed, the conveyance quantity of developer can be easily controlled.

As shown in FIG. 1(A), the aforementioned magnetic roller 33 is composed of a magnet having 8 equal poles or 12 equal poles in which N-poles and S-poles are disposed alternately at regular intervals. In this case, one pole may be omitted to make 7 poles or 11 poles. In order to prevent carrier from adhering onto the image carrier 20, the magnetic force of each magnet is preferably strong. However, there is a limit in the magnetic force since the manufacturing process of the magnet is restricted. Therefore, the maximum magnetic flux density on the circumferential surface of the developing sleeve 32 in the direction of a normal line is maintained to be 500–700 gauss, and in this embodiment, it is maintained to be 600 gauss. Ferrite is utilized for the magnetic roller 33.

The relational position of the developing sleeve 32 and the thin layer forming member 40 is shown in FIG. 1(A). That is, the thin layer forming member 40 is opposed to a pole of the magnetic roller 33 and pressed against the surface of the developing sleeve 32. Further, the thin layer forming member 40 is attracted to the magnetic roller 33 by the induced magnetic force so that the thin layer forming member 40 can be closely contacted with the surface of the developing sleeve 32.

In order to press the aforementioned thin layer forming rod 40 against the developing sleeve, the aforementioned resilient member 43 may be made of a rubber resilient body or a foaming body. An adjustable leaf spring or a coil spring may be used for the resilient member 43.

The shape of the aforementioned thin layer forming rod 40 is not limited to a cylindrical shape. A columnar member, the section of which is a curved surface of the second order, for example, a rod-shaped member, the radius of curvature of which is 1–15 mm, may be used for the developer layer thickness regulating member.

At least the contact portion of the aforementioned thin layer forming rod 40 may be covered with a thin sheet made of urethane rubber or silicon rubber, and the contact portion may be covered with a cured resin layer or a hard glass member. The thickness of the aforementioned rubber member is preferably 0.01 mm–1 mm.

The aforementioned thin layer forming rod 40 is preferably made of a magnetic rigid material. However, a magnet which generates a magnetic field may be used, or a cylindrical member covered with a hard material may be used in which magnetic particles are enclosed.

In the aforementioned apparatus, the thin layer forming rod 40 was made of a rigid rod of polycarbonate, the diameter of which was 6 mm, and a load of 2–4 gf/mm was applied to the thin layer forming rod 40. Then, the uniform conveyance quantity of 7–9 mg/cm$^2$ could be obtained. As a result, a stable image of uniform and even density could be obtained.

In the aforementioned developing unit, even when a resin such as bakelite, or metals such as stainless steel and aluminum, was used for the thin layer forming rod 40, and a rubber such as silicon rubber and fluorine-contained rubber was used for the resilient rubber member 43, the appropriate conveyance quantity could be obtained when the diameter and pushing force of the cylindrical rod 40 were set to an appropriate value, and the size of spacer particle S was set to an appropriate value.

In the apparatus used for the experiment, the surface roughness of the developing sleeve 32 was 3S. When a developing sleeve, the surface roughness of which was 0.1–20S, was used, the same effect could be obtained.

Figure 7:
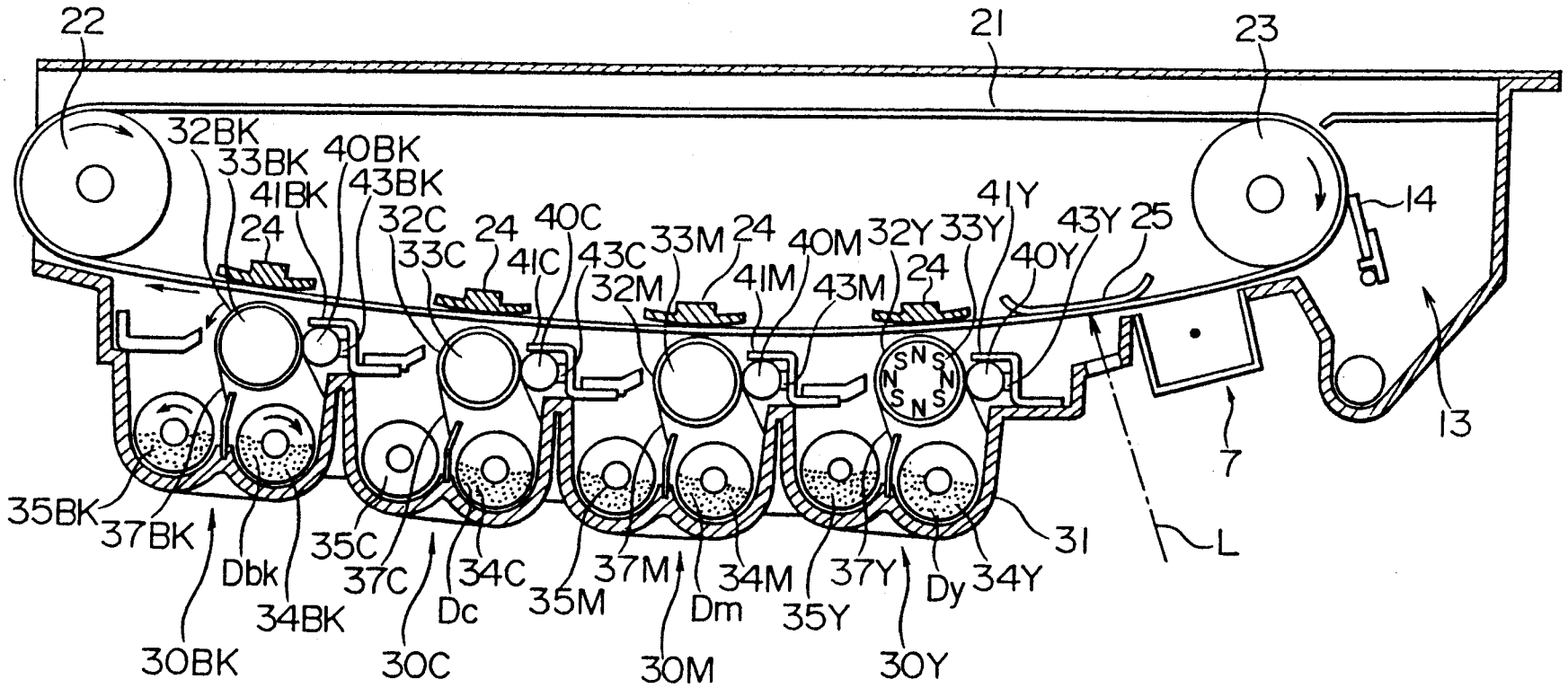
FIG. 7 is a sectional view of a process cartridge of a color printer.

FIG. 7 is a sectional view of a process cartridge of a color printer to which the present invention is applied.

Like parts in each of FIG. 1–FIG. 4 and FIG. 7 are identified by the same reference character. Only points different from the aforementioned embodiment will be explained as follows.

The aforementioned process cartridge is composed of a lower unit including developing units 30Y, 30M, 30C, 30BK, charging unit 7 and cleaning means 13, and composed of an upper unit including a belt-shaped image carrier (photoreceptor belt) 21, drive roller 22 and idle roller 23 to rotate the image carrier 21, a plurality of spacer members 24, and backup plate 25 of the exposure portion. These upper and lower units are structured in such a manner that they can be combined and separated.

U-shaped casings inside which a plurality of developing units 30Y, 30M, 30C, 30BK are installed, are formed close to the bottom of a housing 31 of the lower unit. Inside the U-shaped housing, are provided developing sleeves 32Y, 32M, 30C, 30BK in which magnetic rollers 33Y, 33M, 33C, 33BK are installed, toner conveyance members 34Y, 34M, 34C, 34BK, and stirring screws 35Y, 35M, 35C, 35BK, wherein the aforementioned members are rotatably installed in such a manner that the bearing members are supported by both side members of the housing 31. Between toner conveyance screw 34Y and stirring screw 35Y in the developing unit 30Y, is provided a partition on plate scraper 37Y to which a scraper 37Y is adhered, and the edge of the scraper 37Y lightly comes into contact with the cylindrical surface of the aforementioned developing sleeve 32Y. Scrapers 37M, 37C, 37BK of other developing units 30M, 30C, 30BK are structured in the same manner.

A magnetic rigid thin layer forming rod 40Y is installed in a position close to the aforementioned developing sleeve 32Y so as to form a developer layer thickness regulating means in such a manner that: the thin layer forming rod is supported by a holder 41Y and pressed by a resilient member 43Y so that it can be contacted with the aforementioned developing sleeve 32Y with pressure.

Developer layer thickness regulating means of other developing units 30M, 30C, 30K are structured in the same manner. That is, in the drawing, numerals 40M, 40C, 40BK are cylindrical rods, numerals 41M, 41C, 41BK are holders, and numerals 43M, 43C, 43BK are resilient members.

When an appropriate amount of spacer particles S are mixed with color developers Dy, Dm, Dc, Dbk in the developing units 30Y, 30M, 30C, 30BK of the aforementioned process cartridge, a predetermined thin developer layer can be formed by the same action as described before.

Figure 8:
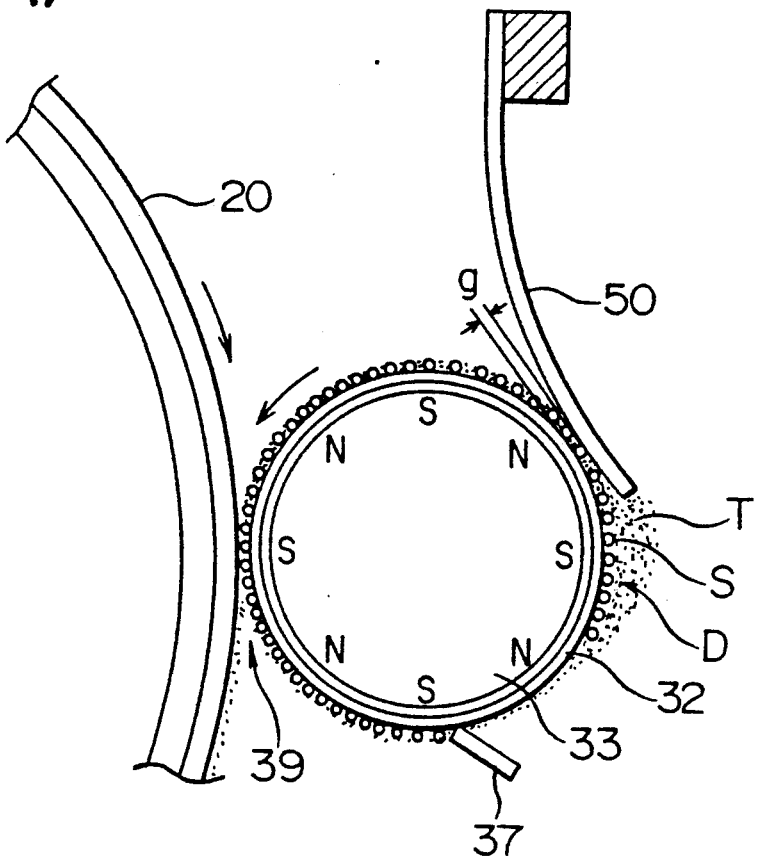
FIG. 8(A) is an enlarged sectional view of a thin layer forming plate and a developing sleeve.
FIG. 8(B) is an enlarged partial view showing the contacting position.
Figure 8:
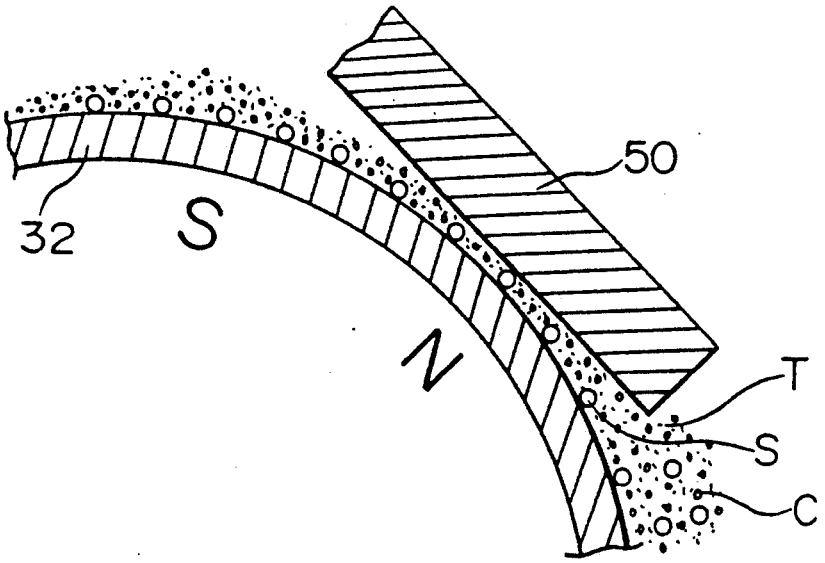

FIG. 8(A) is an enlarged sectional view showing another embodiment of the developer layer thickness regulating means used for formation of a developer layer according to the present invention, and FIG. 8(B) is an enlarged view of the main portion.

In these drawings, an electrostatic latent image is formed on the surface of a drum-shaped image carrier 20 by a charging and exposure means (which are not illustrated in the drawings), and then the drum-shaped image carrier 20 is rotated in the direction of an arrow. A developer carrying member 20 provided close to the image carrier 20 is composed of a developing sleeve 32 made from a non-magnetic material such as aluminum, and a magnetic roller 33 having a plurality of magnetic poles arranged in the circumferential direction. In the magnetic roller 33, 4 S-poles and 4 N-poles are arranged alternately. It is preferable that the intensity of the magnetic field is 300–1500 gauss on the developing sleeve 32. In this embodiment, a magnetic roller, the intensity of which is 700 gauss, was utilized. It is preferable that a stainless steel sleeve, the surface roughness of which is 1–10 μm, is used for the non-magnetic developing sleeve 32. In this embodiment, a non-magnetic cylindrical sleeve was used, the diameter of which was 20 mm, and the surface roughness was 3 μm. It is preferable that the rotating speed of the developing sleeve 32 is 100–500 rpm. In this embodiment, the rotating speed of the developing sleeve 32 was set to 240 rpm. It is preferable that the rotating speed of the magnetic roller 33 is 2–5 times as high as that of the developing sleeve 32. In this embodiment, the rotating speed of the magnetic roller 33 was set to 800 rpm. In order to convey developer D from a developer reservoir to a developing region 39, either of the following methods may be adopted: the developing sleeve 32 is fixed, and the magnetic roller 33 is rotated: on the contrary, the magnetic roller 33 is fixed, and the developing sleeve 32 is rotated; and both the developing sleeve 32 and magnetic roller 33 are rotated. When the developing sleeve 32 is rotated, developer D is conveyed in the same direction as that of the rotation of the developing sleeve 32. However, when the magnetic roller 33 is rotated, developer D is conveyed in the direction opposite to that of the magnetic roller 33.

FIG. 8(A) is a drawing in which the magnetic roller 33 is fixed and the developing sleeve 32 is rotated counterclockwise. At this time, the magnetic flux density of a magnetic pole of the magnetic roller 33 which is opposed to the image carrier 20, is higher than that of other magnetic poles. In order to further increase the magnetic flux density of the magnetic pole opposed to the image carrier 20, 2 magnetic poles of homopolar or heteropolar may be disposed close to each other.

A thin layer forming plate (a resilient plate) 50 is fixed to a support member 51. It is appropriate that the thickness of the resilient body 50 is 0.05–0.2 mm. In this embodiment, the thickness of the resilient body 50 was 0.1 mm. It is appropriate that the elastic modulus of the resilient plate 50 is 5000–25000 kgf/mm$^2$. In this embodiment, the elastic modulus of the resilient plate 50 was 11000 kgf/mm$^2$. Stainless steel, brass and carbon steel are preferably used for the resilient plate 50. In this embodiment, phosphor bronze was used. It is preferable that the length from the position where the resilient member 50 is fixed to the support member 51, to the tip of the resilient plate 50, is 5–20 mm. In this embodiment, the length was set to 15 mm. It is appropriate that the contact position of the resilient member 50 and the developing sleeve 32 is located 1 mm apart from the tip of the resilient member 50 and its line pressure is 1–10 g/mm. In this embodiment, the line pressure was set to 1 g/mm.

Developer D conveyed on the circumferential surface of the developing sleeve 32 being attracted by magnetic force of the magnetic roller 33, is formed to a developer layer of a predetermined thickness. In this embodiment, the developer layer was formed so that its thickness was 250 μm–450 μm. The developer layer is further conveyed to a developing region 39. A portion of developer D is attracted onto the image carrier 20, and the rest is conveyed on the circumferential surface of the developing sleeve 32 in the direction of an arrow, and then the developer is removed from the circumferential surface of the developing sleeve 32 by a scraper 37.

In the structure described above, the thin layer forming plate 50 comes into contact with the circumferential surface of the developing sleeve 32 with pressure. Developer D including carrier C, toner T and spacer particles S is attracted onto the circumferential surface of the developing sleeve 32, and conveyed when the developing sleeve 32 is rotated. When developer D passes through the contact portion, the gapg between the thin layer forming plate 50 and the developing sleeve 32 is maintained so that spacer particles S can be passed through. Accordingly, the thickness of the developer layer is maintained to be a predetermined thickness, and conveyed to the developing region 39.

Figure 9:
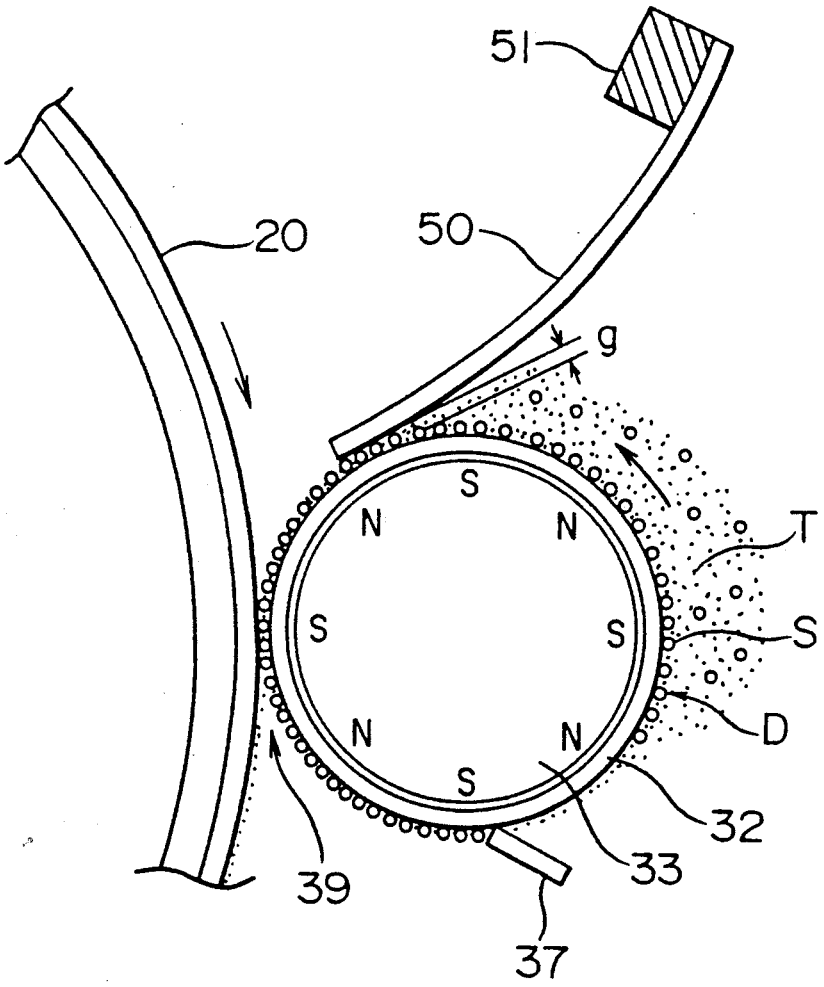
FIG. 9 is an enlarged sectional view showing another embodiment of the thin layer forming plate.

In FIG. 9, an embodiment is shown in which the aforementioned thin layer forming plate 50 is disposed in such a manner that the contact surface of the thin layer forming plate 50 is set so that it sweeps the surface of the developing sleeve 32 when the developing sleeve 32 is rotated in the direction of an arrow. In this case, spacer particles S are conveyed together with developer D, so that gap g can be maintained constant.

Figure 10:
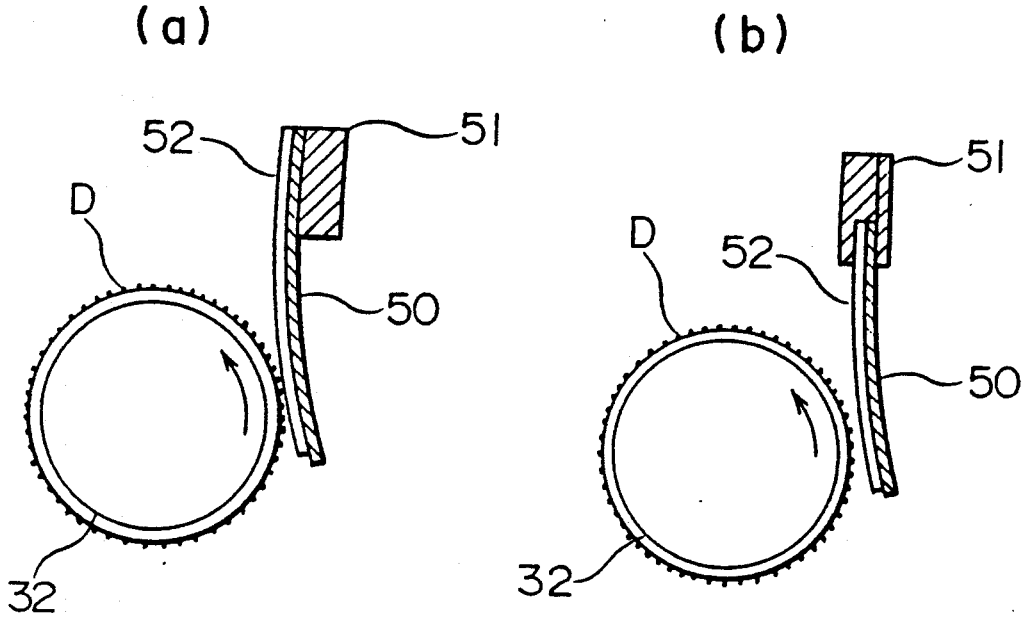
FIG. 10 and FIG. 11 are sectional views showing another embodiment of the thin layer forming plate.

FIG. 10 is a sectional view showing further another embodiment of a developer layer regulating means which is utilized for the developer layer forming method of the present invention.

In this embodiment, the developer layer regulating member is composed in such a manner that: a resilient rubber member 52 is laminated on the thin layer forming plate 50 made from a metal or resin.

The resilient rubber plate 52 is made of a polyurethane rubber member of 0.114 2.0 mm thick, the rubber hardness of which is 40–90 $H_S$. The thin layer forming plate 50 is made of a thin metallic plate such as a phosphor bronze plate and a stainless plate, or a resin plate such as a polyethylene terephthalate (PET) plate of 0.114 1.0 mm thick. The aforementioned thin layer forming plate 50 is adhered to the resilient rubber plate 52 with an adhesive tape, an adhesive agent or by means of thermal adhesion, and then the thin layer forming plate 50 is adhered to the support member 51 through a pressure sensitive adhesive double coated tape.

Instead of the pressure sensitive adhesive double coated tape, an adhesive agent may be applied.

FIG. 10(*b*) shows an example in which the resilient rubber plate 52 and the thin layer forming plate 50 are not adhered to each other, wherein the resilient rubber plate 52 and the thin layer forming plate 50 are mechanically pinched by the support member 51 as shown in the drawing.

In this case, the contact position of the aforementioned resilient rubber plate 52 and the developing sleeve 32, and the amount of deformation can be found by the pushing force, and the amount of play of a tip which have been disclosed in the official gazettes of Japanese Patent Publication Open to Public Inspection Nos. 191868/1987 and 191869/1987.

In this embodiment, a resilient rubber member is applied to the portion which comes into contact with toner and carrier and lining is conducted, so that the rubber member can uniformly push the developing sleeve 32. Accordingly, deposition of toner does not occur, and a uniform and stable developer layer can be formed.

In either case (a) or case(b) described above, even when strain is caused in the rubber member when it is adhered or pinched, the rubber member is pressed by the thin layer forming plate 50 made of a metal or a synthetic resin, to the developing sleeve 32, so that deformation of the resilient rubber plate 52 can be prevented and uniform image formation can be stably conducted over a long period of time.

Figure 11:
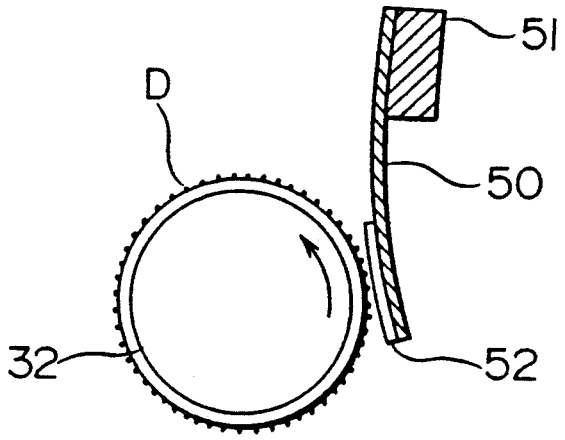

In FIG. 11, an embodiment is shown in which a resilient rubber member 52 is adhered only to the position on a thin layer forming plate 50 made from a metal or a synthetic resin, which comes into contact with the developing sleeve 32. The resilient rubber plate 52 is made of a rubber plate such as a polyurethane plate of 1–3 mm thick, the rubber hardness of which is preferably 50°–70°, and the resilient rubber plate 52 is fixed to the support member 51. Developer layer formation can be stabilized by the resilient rubber member 52, and the strain caused in the rubber member can be solved in this embodiment, too.

As described above, in the embodiment of the developer layer thickness regulating means according to the present invention, the resilient rubber plate 52 is supported by a resilient plate-shaped member(the thin layer forming plate 50) made from a metal or a synthetic resin in such a manner that the resilient plate-shaped member is adhered to, or contacted with the resilient rubber plate 52 on the side which is opposite to the contact surface with the developing sleeve. Accordingly, flapping is not caused which may occur when only a thin resilient rubber member is used.

In the case of the developing unit in which the developer layer thickness regulating means shown in FIGS. 10, 11 is utilized, the thickness of a developer layer can be controlled to be a predetermined value in such a manner that: spacer particles S contained in developer D composed of carrier C and toner T, regulates the gap formed between the developing sleeve 32 and the thin layer forming plate 50 at the contact position.

Figure 12:
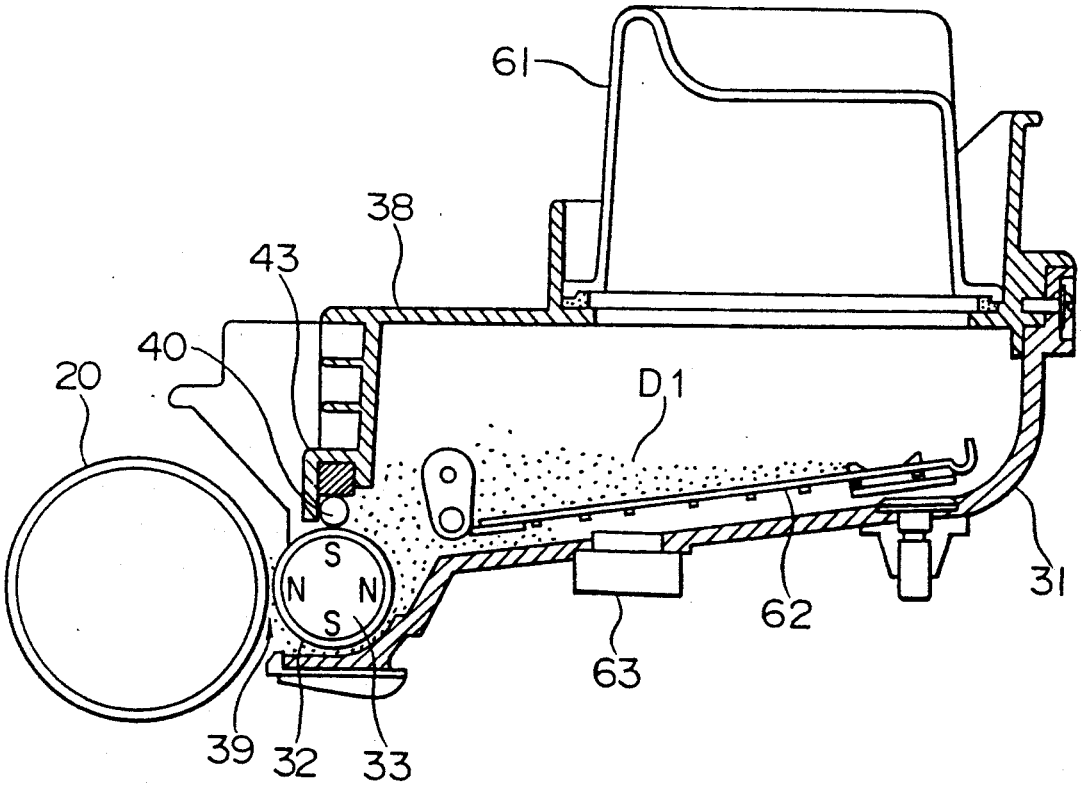
FIG. 12 is a sectional view of developing unit in which one-component developer is used.

FIG. 12 is a sectional view of a developing unit in which one-component developer not containing carrier C is utilized.

Like parts in each of FIG. 2 and FIG. 12 are identified by the same reference character. Explanations will be conducted only on the portions which are different from the aforementioned embodiment.

In FIG. 12, numeral 61 is a toner supply container, numeral 62 is a vibrational plate to stir toner, and numeral 63 is a remaining toner amount detecting means.

One-component developer D1 which is supplied from the aforementioned toner supply container 61 to the inside of a housing of the developing unit, is mainly composed of magnetic toner, and further contains the aforementioned spacer particles S.

The specification of the aforementioned one-component developer D1 is shown in Table 7.

TABLE 7

| Developer | Particle Size (Average by Weight) | Shape | Coating Material | Core | Magnetization |
|---|---|---|---|---|---|
| Spacer Particle (S) | 30 μm | Spherical | Styrene Acrylic Resin 2 μm thick | Ferrite | 15 emu/g |
| Toner (T) Magnetic Toner | 5 μm | | Styrene Acrylic Resin | Magnetite | 25 emu/g |

The aforementioned spacer particles S are magnetic particles having a uniform grain size. The aforementioned spacer particles S were added in such a manner that the weight ratio of spacer particles S to toner T was 1/10:1.

As a result of the experiment performed under the aforementioned condition, when developer D1 containing the aforementioned spacer particles S passes through the contact position formed by the developer layer regulating member (the thin layer forming rod) being pushed by the resilient member 43, and the developing sleeve 32, a gap is formed which is approximately the same as the particle size of spacer particles S. Developer D1 held on the surface of the developing sleeve 32, passes through the gap and a developer layer of a predetermined thickness is formed and conveyed to the developing region 39. In the developing region 39, an electrostatic latent. image on the image carrier 20 is developed and a toner image is formed.

When the aforementioned magnetic spacer particles S were attracted onto the surface of the developing sleeve 32 and conveyed, magnetic toner T could be more positively conveyed, so that clogging of toner was reduced which tends to occur in the contact position of the aforementioned thin layer forming rod 40 with the developing sleeve 32.

Further, flow of toner T was improved in the developing region 39 where the developing sleeve 32 was opposed to the image carrier 20. Furthermore, a magnetic brush was uniformly formed by the magnetic field and developing could be carried out stably, and at the same time, the range of setting latitude was extended.

The size of magnetic particle S suitable for the developer layer forming method, was found by an experiment, and a good result was obtained by toner T, the size of which was larger than that of the aforementioned one-component toner T, in other words, a good result was obtained by toner, the particle size of which was 30–150 μm. In the case of the aforementioned experiment, an appropriate mixing ratio of spacer particles S to one-component magnetic toner T on the developing sleeve 32 was approximately 1/10 by weight. A good result could be obtained the ratio was in the range of 1/100–⅔.

In the experiments, iron powder and ferrite were used for the spacer particles. The material did not make any difference. However, when the resistance of spacer particles S was low and the size was small, spacer particles S were adhered onto the surface of the image carrier 20 by the action of electrostatic induction, so that a good result could not be obtained.

Further, the aforementioned spacer particles S are more strongly attracted to the developing sleeve 32 than toner T. Therefore, they are not conveyed to the image carrier 20 side. In other words, spacer particles S are not taken into a toner image together with toner T, so that spacer particles S remain on the surface of the developing sleeve 32. Accordingly, even when developing operations are repeatedly conducted, spacer particles S are not consumed.

Furthermore, only a small amount of spacer particles S are added to developer, and their electrical property is not utilized in the operation, so that deterioration with time is hardly caused in spacer particles S, and even when spacer particles S are magnetized, it causes no problem. When spacer particles S are added into developer D, they can be repeatedly used. Of course, they may be replaced.

Remarkable effects can be provided when the aforementioned spacer particles S are utilized not only for improvements in developer layer thickness regulation and conveyance property, but also for improvements in aggregating property of developer. In an environment of high humidity, toner T tends to be aggregated. However, by the action of spacer S, aggregations caused in the housing 31 can be effectively broken.

In the case where weak-magnetic or non-magnetic spacer particles S of low resistance are utilized, the units are disposed as shown in FIG. 7 in which the image carrier 21 is located above the developing sleeve 32 so that spacer particles S can not fall off when they are conveyed by the developing sleeve 32 together with toner T to the developing region.

Instead of the aforementioned thin layer forming rod 40, a resilient thin layer forming plate 50 shown in FIG. 8–FIG. 11 can be utilized for the developer layer thickness regulating means of a developing unit in which the aforementioned one-component developer D1 is used.

As explained above, the developer layer forming method of the present invention is composed in such a manner that: rigid spacer particles of a predetermined uniform particle size are contained in developer; and the aforementioned spacer particles are conveyed onto the developing sleeve so that they are pressed by the developer layer regulating member. Therefore, a developer layer of uniform thickness can be stably formed. Consequently, a developer layer of uniform thickness can be stably obtained at a lower load than that of a conventional apparatus.

The method of the present invention is advantageous in that: clogging with foreign substances is hardly caused; and aggregations of toner and developer can be easily broken, so that white streaks hardly appear on the image. Even when the pushing force of the developer layer thickness regulating means to the developing sleeve is varied, the fluctuation in the developer layer thickness is extremely small, so that the developing property can be improved. Especially, in the case of a 2-component developer, adhesion of developer to the regulating member can be prevented. Accordingly, a uniform developer layer can be stably formed, and an image of high quality, in which image density is uniform and high, can be provided.

According to the method of the present invention, the developer layer thickness regulating member is not deformed even when it is used over a long period of time, and further magnetic attraction force is not varied, so that durability is very high. When the developing unit is mass-produced, accuracy is allowed some latitude, and the method of the present invention can be sufficiently put into practical use.

The developer regulating area is small, so that unnecessary triboelectric charging with developer can be eliminated and an excellent image can be obtained. Furthermore, the regulating member can be easily replaced in maintenance, so that maintainability is high.

When a non-linear resilient member is utilized for the pushing member of the thin layer forming rod, inaccuracy and fluctuation of the casing and holder caused in the manufacturing process can be absorbed, so that a constant amount of developer can be always conveyed without providing an adjustment portion.

When the spacer particles of the present invention are contained in developer, it is very effective not only for improvements in the developer layer thickness regulating effect and conveyance property, but also for preventing aggregation of developer.

The contact or the non-contact developing method of the present invention is conducted as follows: Rigid spacer particles having a uniform predetermined particle size, are contained in 2-component or one-component developer; the spacer particles are conveyed onto the developing sleeve and pressed by the developer layer thickness regulating member; an AC bias voltage is impressed upon the developing sleeve in the developing region so that the carrier in the 2-component developer and the spacer particles are attracted onto the developing sleeve; and the developer is moved on the image carrier to form a toner image.

Due to the foregoing, the electrical field of the image edge portion has little influence upon the image, and the reproducibility of fine lines and minute characters can be improved. Consequently, image quality can be improved.

When a plurality of developing units of a color image forming apparatus to which the non-contact developing method of the present invention is applied, are provided around the image carrier drum, it is possible to transfer a multi-color toner image which has been superimposed on the surface of the image carrier, onto a transfer paper all at once. Accordingly, a small sized color image forming apparatus can be provided, and images of high resolution, excellent image color and gradation reproducibility can be obtained.

What is claimed is:

1. A method of forming a developer layer on a rotating developing sleeve for developing a latent image, said method comprising the steps of:

(a) carrying developer in the circumferential surface of the sleeve, the developer including spacer particles having a substantially uniform diameter;

(b) pressing a developer layer regulating means onto the developer carried on the circumferential surface of the sleeve; and (c) passing the developer through a nip position between the sleeve and the developer layer regulating means to form a predetermined gap therebetween, the gap being substantially equal in size to the diameter of the spacer particles so that the developer layer on the sleeve can be formed and maintained.

2. The method of claim 1 wherein the developer comprises two-component developer composed of magnetic carrier and toner, and an average diameter of the spacer particles is greater than a maximum diameter of the magnetic carrier particles.

3. The method of claim 1 wherein the developer comprises single-component developer, and diameter of the spacer particles is greater than a maximum diameter of single-component developer particles.

4. The method of claim 1 wherein the spacer particles comprise magnetic particles.

5. The method of claim 1 wherein the portion of the developer layer regulating means pressed against the developer comprises a rigid body.

6. The method of claim 1 wherein the portion of the developer layer regulating means pressed against the developer comprises an elastic body.

7. The method of claim 1 wherein the sleeve comprises a metallic sleeve having magnetic field generating means inside thereof.

8. The method of claim 1 wherein the developer layer regulating means comprises a ferromagnetic body, and the pressing force of the developer layer regulating means towards the sleeve is the magnetic attraction of the ferromagnetic body.

9. The method of claim 1 wherein the pressing force towards the sleeve is elastic force.

10. The method of claim 1 wherein the shape of the spacer particles is substantially spherical.

11. The method of claim 2 wherein the spacer particles comprise magnetic spacer particles, the latent image is developed with the developer on the sleeve in an alternating electric field by means of non-contact development, and further comprising applying an A.C. bias voltage to the sleeve and the image carrier so that the spacer particles and the carrier particles can be restrained to the surface of the sleeve and the toner becomes movable to the image carrier.

12. The method of claim 2 wherein the spacer particles comprise magnetic spacer particles, the latent image is developed with the developer on the sleeve by means of contact development, and further comprising applying an A.C. bias voltage to the sleeve and the image carrier so that the spacer particles and the carrier particles can be restrained to the surface of the sleeve and the toner becomes movable to the image carrier.

13. The method of claim 3 wherein the spacer particles comprise magnetic spacer particles, the latent image is developed with the developer on the sleeve in an alternating electric field by means of non-contact development, and further comprising applying an A.C. bias voltage to the sleeve and the image carrier so that the spacer particles and the carrier particles can be restrained to the surface of the sleeve and the toner becomes movable to the image carrier.

14. The method of claim 3 wherein the spacer particles comprise magnetic spacer particles, the latent image is developed with the developer on the sleeve by means of contact development, and further comprising applying an A.C. bias voltage to the sleeve and the image carrier so that the spacer particles nd the carrier particles can be restrained to the surface of the sleeve and the toner becomes movable to the image carrier.

* * * * *